US006297792B1

(12) United States Patent
Takahashi

(10) Patent No.: US 6,297,792 B1
(45) **Date of Patent: *Oct. 2, 2001**

(54) APPARATUS FOR DRIVING LIQUID CRYSTAL DISPLAY PANEL, LIQUID CRYSTAL DISPLAY APPARATUS, ELECTRONIC APPARATUS, AND METHOD OF DRIVING LIQUID CRYSTAL DISPLAY PANEL

(75) Inventor: Kotoyoshi Takahashi, Shiojioi (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/182,305

(22) Filed: Oct. 30, 1998

(30) Foreign Application Priority Data

Oct. 30, 1997 (JP) ..... 9-299223

(51) Int. Cl.[7] ..... G09G 3/36
(52) U.S. Cl. ..... 345/91; 345/94; 345/208
(58) Field of Search ..... 345/87, 94, 95, 345/99, 91, 96, 204, 208, 209

(56) References Cited

U.S. PATENT DOCUMENTS 5,151,691 * 9/1992 Kuijk ..... 345/91
5,379,050 * 1/1995 Annis et al. ..... 345/94
5,561,441 * 10/1996 Hamano ..... 345/91
5,757,349 * 5/1998 Togashi ..... 345/91
5,892,504 * 4/1999 Knapp ..... 345/204

* cited by examiner

*Primary Examiner*—Kent Chang
(74) *Attorney, Agent, or Firm*—Oliff & Berridge, PLC

(57) ABSTRACT

The invention prevents crosstalk of preceding data and to improve contrast in a liquid crystal display panel using a two-terminal type non-linear element such as a MIM element even when a charge and discharge drive method is used as a method of driving the liquid crystal display panel. A scanning signal is formed of a signal in a charging mode and a signal a discharging mode. A charging period in which the voltage value of a first selecting voltage in the charging mode is applied is set as a predetermined period in a first horizontal period. An overcharging period in which the voltage value of a precharge voltage in the discharging mode is applied is set as the first half of a second horizontal period vertical period after the first horizontal period, and a discharging period in which a second selecting voltage is applied is set as the second half of the second horizontal period. A data signal in the charging mode is supplied in the predetermined period (charging period) in the above-mentioned first horizontal scanning period while a data signal in the discharging mode is supplied both in the first half and in the second half of the second horizontal period (overcharging period and discharging period) without changing its polarity.

26 Claims, 16 Drawing Sheets

APPARATUS FOR DRIVING LIQUID CRYSTAL DISPLAY PANEL, LIQUID CRYSTAL DISPLAY APPARATUS, ELECTRONIC APPARATUS, AND METHOD OF DRIVING LIQUID CRYSTAL DISPLAY PANEL

BACKGROUND OF THE INVENTION

1. Field of Invention

The present invention relates to an apparatus for driving a liquid crystal display panel, a liquid crystal display apparatus, and an electronic apparatus and, more particularly, to an apparatus and method for driving an active matrix drive type of a liquid crystal display panel using a two-terminal type non-linear element such as a MIM (metal insulator metal) element having a bidirectional diode characteristic, to a liquid crystal display apparatus provided with the driving apparatus (liquid crystal display module), and to an electronic apparatus provided with the liquid crystal display apparatus.

2. Description of Related Art

Conventional active matrix drive type of liquid crystal display panels include those using a two-terminal type non-linear element such as a MIM element having a bidirectional diode characteristic, as well as those using TFT (thin-film transistor) elements. MIM elements, etc., have a sharper change at a threshold and therefore have the advantage of being simple in structure and being manufactured by a simpler process in comparison with TFT elements.

FIG. 15 shows a liquid crystal display panel using a MIM element as the above-mentioned two terminal type non-linear element. This liquid crystal display panel is constructed in such a manner that, as shown in FIG. 15, a liquid crystal layer and a MIM element layer are connected in series to form one pixel region at each of intersections of a plurality of data signal lines ( . . . , Xi−1, Xi, Xi+1 . . . ) and a plurality of scanning signal lines ( . . . , Yj−1, Yj, Yj+1 . . . ), which are respectively arranged on a pair of substrates so as to form a matrix. A scanning signal drive circuit 81 is connected to the scanning signal lines while a data signal drive circuit 82 is connected to the data signal lines. From the scanning signal drive circuit 81, a scanning signal is supplied to each scanning signal line. From the data signal drive circuit 82, a data signal is supplied to each data signal line. In each pixel region, therefore, the MIM element can be driven in an on-off manner if the potential difference between the scanning signal and the data signal at the pixel region is set in a certain level relationship with the threshold voltage of the MIM element. When the MIM element is turned on, the liquid crystal layer connected to the MIM element is charged to turn on the pixel region. After charging for a predetermined time period, the MIM element is turned off and set in a high-impedance state. This state of the MIM element and the resistance of the pixel region set to a sufficiently large value enable the charge on the liquid crystal layer to be retained, thereby maintaining the on state of the pixel region. As the time for selecting and charging one of the pixel regions (hereinafter referred to as "selecting period"), a part of the time period through which the pixel region is maintained in the on state may suffice, as described above. Therefore, this selecting period can be set with respect to each of the scanning signal lines in a time division manner, thus enabling matrix drive of the plurality of pixel regions sharing the scanning signal lines and the data signal lines.

As a typical example of such a drive method, a drive method called four-value drive method can be mentioned. A four-value drive method is a method of using a two-value scanning signal and a two-value data signal and inverting the polarities of the scanning signal and the data signal about the middle value of the data signal with the passage of every horizontal period, for example, and inverting the polarities about the middle value of the data signal with the passage of every vertical period with respect to each scanning signal line. This method can be practiced with a comparatively simple circuit arrangement.

As mentioned above, the liquid crystal display panel using the MIM element is constructed so that the MIM element and the liquid crystal layer are connected in series in each pixel region. Accordingly, the voltage applied to the liquid crystal layer immediately after each selecting period depends upon the voltage applied to the MIM element at the corresponding time. The voltage applied to the MIM element at the corresponding time, i.e., the voltage applied to the MIM element when charging of the liquid crystal layer is stopped substantially completely, depends upon the current-voltage characteristic of the MIM element. Therefore, an error can occur in the voltage applied to each of the MIM elements due to a variation in the current-voltage characteristics of the MIM elements. Such a voltage error cannot be canceled out in the four-value drive method or the like, in which the polarities of scanning and data signals are simply inverted about the middle value of the data signal with the passage of every vertical period to simply invert the polarity of the voltage applied to the liquid crystal layer. Consequently, an error of the above-described kind occurs between the pixel regions to cause a variation in the voltage applied to the liquid crystal layer in each pixel region, which results in a display unevenness or the like.

A drive method called charge and discharge method has been proposed as a drive method for achieving an improvement in display characteristics in comparison with the four-value drive method. This drive method comprises making a MIM element conductive by charging and making the MIM element conductive by discharging after overcharging opposite in polarity to the charging about the middle value of a data signal, and is arranged for driving in charging and discharging modes, as shown in FIGS. 16(B) and 17(C). In the charging mode, a first selecting voltage (VS1) is supplied to one scanning signal line to charge the liquid crystal layer by the voltage of the potential difference from a data signal. On the other hand, in the discharging mode, a voltage−VPRE which is a precharge voltage opposite in polarity to the first selecting voltage (VS1) about the middle value of the data signal is supplied to overcharge the liquid crystal layer. Successively, a second selecting voltage (VS2) opposite in polarity to the precharge voltage about the middle value of the data signal is supplied to discharge the overcharged liquid crystal layer. Therefore, if the amount of discharge is controlled by the data signal during the time period through which the second selecting voltage (VS2) is supplied, the displaying state of the pixel region can be controlled.

For example, if, as shown in FIG. 16(A), a data signal having values VH/2 and −VH/2 is supplied to data signal line Xi in every horizontal period (the period indicated by 1H in FIG. 16(A)), and if, as shown in FIG. 16(B), a scanning signal having a selecting potential such as that described above is supplied to scanning signal line Yj, voltage VB1 applied to the liquid crystal layer in the pixel region at the intersection of data signal line Xi and scanning signal line Yj immediately after the end of the selecting period in the charging mode is given by the following equation.

$$VB1=(VS1+VH/2-VON)-K\cdot(VS1-VH/2) \quad (1)$$

wherein K is a capacitance ratio expressed as CM/(CM+CL) if the capacitance of the MIM element is CM and the capacitance of the liquid crystal layer is CL; K·(VS1−VH/2) represents a shift of the liquid crystal layer voltage caused through capacitive coupling at the moment when the MIM element is turned off; and VON is the voltage applied to the MIM element when charging of the liquid crystal layer is stopped substantially completely.

In the discharging mode, after overcharging at precharge voltage−VPRE, the accumulated charge is discharged by the second selecting voltage VS2, so that the voltage applied to the liquid crystal layer after the end of the selecting period is VS2−VH/2−VON. Accordingly, the voltage VB2 applied to the liquid crystal layer immediately before the end of the selecting period is shown by the following equation.

$$VB2=(VS2-VH/2-VON)-K\cdot(VS2-VH/2)=-\{(VON-VS2+VH/2)+K\cdot(VS2-VH/2)\} \quad (2)$$

wherein K·(VS2−VH/2) represents a shift of the liquid crystal layer voltage caused through capacitive coupling at the moment when the MIM element is turned off, as in the case of the charging mode.

As is apparent from the above equations (1) and (2), if the voltage VON applied to the MIM element becomes higher by DVON when charging of the liquid crystal layer is stopped substantially completely, the absolute value of VB1 becomes smaller by DVON and, conversely, the absolute value of VB2 becomes larger by DVON. On the other hand, if VON becomes smaller by DVON, the absolute value of VB1 becomes larger by DVON but the absolute value of VB2 becomes smaller by DVON. Further, if an error DK occurs in K, and if the absolute value of VB1 becomes larger by this error, the absolute value of VB2 becomes smaller. If the absolute value of VB1 becomes smaller by this error, the absolute value of VB2 becomes larger.

Thus, according to the charge and discharge drive method, even if VON of the MIM element changes, an error voltage caused in the liquid crystal applied voltage in the charging mode is canceled out, in terms of effective voltage, by an error voltage caused in the liquid crystal applied voltage in the discharging mode. Consequently, it is possible to effectively prevent occurrence of a display unevenness or the like due to a variation in VON of the MIM elements in the liquid crystal display panel.

The drive method shown in FIG. 16, however, has a drawback in that crosstalk of data can occur easily. For example, if a data signal having values such as shown in FIG. 17(A) is supplied to data signal line Xi and if scanning signals having values such as shown in FIGS. 17(B) and 17(C) are supplied to scanning signal lines Yj−1 and Yj, each of voltages of a waveform such as shown in FIG. 17(D) is applied between the opposite ends of the MIM element and the liquid crystal layer in pixel region (Xi, Yj) at the intersection between data signal line Xi and scanning signal line Yj. As shown in FIG. 17(D), the voltage applied between the opposite ends of the MIM element and the liquid crystal layer in overcharging period Tdcj in the overcharging mode is −VPRE−VH/2. This is because the scanning signal supplied to scanning signal line Yj has voltage−VPRE and the value of data signal kDi,j−1 supplied to data signal line Xi in this period is VH/2. Letter k in the symbol for the data signal denotes the field number, the suffix i attached to the symbol D for symbolization of data denotes the number of the data signal line, and the suffix j−1 denotes the number of the scanning signal line. That is, data signal kDi,j−1 is a data signal for the pixel region corresponding to the intersection of data signal line Xi and scanning signal line Yj−1 when the kth field is formed.

In discharging period Tdj for the pixel region (Xi, Yj), data signal kDi,j for the pixel region (Xi, Yj) is supplied to enable the voltage between the opposite ends of the MIM element and the liquid crystal layer to be set to the desired value. However, the above-described voltage between the opposite ends of the MIM element and the liquid crystal layer in overcharging period Tdcj depends upon the value of data signal kDi,j−1 supplied to the pixel region at the intersection of scanning signal line Yj−1 and data signal Xi one line before, resulting in occurrence of crosstalk. Such a crosstalk can occur because each of overcharging period Tdcj and discharging period Tdj is set in one horizontal period.

To eliminate such a crosstalk, a drive method such as shown in FIG. 18 has been proposed. FIG. 18(A) shows a data signal supplied to data signal line Xi, and FIG. 18(B) shows a scanning signal supplied to scanning signal line Yj−1. Also, FIG. 18(C) shows a scanning signal supplied to scanning signal line Yj, and FIG. 18(D) shows voltages applied between the opposite ends of the MIM element and the liquid crystal layer in pixel region (Xi, Yj) at the intersection between data signal line Xi and scanning signal line Yj.

In this drive method, as shown in FIG. 18(A), a data signal is supplied only in the second half of one horizontal period while the ground potential is supplied in the first half period. As shown in FIG. 18(B), a period for charging with the scanning signal in the charging mode is also set in the second half of one horizontal period. As shown in FIG. 18(C), overcharging period Tdcj in the overcharging mode is set in the first half of one scanning period, and discharging period Tdj is set in the second half of the one scanning period.

The voltage applied between the opposite ends of the MIM element and the liquid crystal layer in overcharging period Tdcj is thereby made−VPRE independent of the data signal value, as shown in FIG. 18(D), thus preventing crosstalk of the data signal.

In the drive method shown in FIG. 18, however, charging is performed only in the second half of one horizontal period in the charging mode and overcharging is performed in the overcharging mode only when the data signal value is at the ground potential. Therefore, a sufficient voltage cannot be applied to the liquid crystal layer, resulting in a reduction in contrast.

With respect to this problem, it is conceivable that the peak to peak amplitude of the scanning signal is increased to compensate for a deficiency of the charging voltage. However, if the applied voltage is increased, the MIM element exhibits a saturated characteristic such that the amount of charge in the overcharging period in the overcharging mode is limited. Therefore, this drive method is not substantially effective in solving the problem of low contrast.

Also, the absolute value of precharge voltage VPRE of the scanning signal in the overcharging period may be increased. However, the increase in this precharge voltage VPRE is limited because of the withstand voltage performance of the liquid driver provided in the scanning signal drive circuit 81.

SUMMARY OF THE INVENTION

The present invention has been achieved in consideration of the above-described problem, and an object of the present invention is to provide a drive circuit for a liquid crystal display panel capable of avoiding crosstalk of preceding data and improving contrast even if a charge and discharge drive method is used as a method of driving a liquid crystal display panel having a two-terminal type non-linear element such as a MIM element, and to provide a drive method, a liquid crystal display panel, a liquid crystal display apparatus, and an electronic apparatus.

To solve the above-described problem, an apparatus for driving a liquid crystal display panel is arranged in a liquid crystal display apparatus in which a plurality of scanning lines to which a scanning signal is applied and a plurality of data lines to which a data signal is applied are arranged so as to form a matrix. The liquid crystal display apparatus has a plurality of pixels each formed of a liquid crystal and a two-terminal type non-linear element connected in series between the plurality of scanning lines and the plurality of data lines. The apparatus for driving a liquid crystal display panel may include:

a scanning signal drive circuit that forms a scanning signal having a charging mode and a discharging mode, the charging mode having a first selecting voltage which makes the two-terminal type non-linear element conductive, the discharging mode having a precharge voltage which makes the two-terminal type non-linear element conductive and which is opposite in polarity to the first selecting voltage about a middle value of the data signal, and a second selecting voltage which is output subsequently to the precharge voltage and which is opposite in polarity to the precharge voltage about the middle value of the data signal, the scanning signal drive circuit that supplies the first selecting voltage of the charging mode in a first horizontal period, supplying the precharge voltage of the discharging mode in the first half of a second horizontal period one vertical period after the first horizontal period, and supplies the second selecting voltage of the discharging mode in a second half of the second horizontal period; and a data signal drive circuit that supplies, by timing based on a cycle of one horizontal period, the data signal for controlling a grayshade of each of the pixels in the period through which the first selecting voltage is supplied in the charging mode, and also supplies, by timing based on a cycle of one horizontal period the data signal both in the first half and in the second half of the second horizontal period in which the precharge voltage and the second selecting voltage are supplied in the discharging mode.

According to the apparatus for driving a liquid crystal display panel, when, in the first horizontal period, the first selecting voltage is supplied in the charging mode as a scanning signal to one of the plurality of scanning lines by the scanning signal drive circuit, a data signal for controlling a grayshade of one of the pixels is supplied to the corresponding data line at least in the first horizontal period by the data signal drive circuit. A voltage corresponding to the difference between the voltage value of the data signal and the value of the first selecting voltage of the scanning signal is thereby generated between the opposite ends of the two-terminal type non-linear element and the liquid crystal to make the two-terminal type non-linear element conductive, thereby charging the liquid crystal.

Next, in the discharging mode forming a scanning signal in combination with the charging mode, the precharge voltage opposite in polarity to the first selecting voltage about the middle value of the data signal, and the second selecting voltage which is output subsequently to the precharge voltage and which is opposite in polarity to the precharge voltage about the middle value are supplied to the scanning line by the scanning line drive circuit. The precharge voltage is supplied in the first half of a second horizontal period one vertical period after the first horizontal period, a voltage corresponding to the difference between the voltage value of the data signal and the voltage value of the overcharging mode signal is generated, and the two-terminal type non-linear element becomes conductive, thereby overcharging the liquid crystal. The subsequent second selecting voltage is supplied in the second half of the second horizontal period after one vertical period to perform discharging of the overcharged voltage across the liquid crystal layer according to the voltage value corresponding to the difference between the voltage value of the data signal and the value of the second selecting voltage. The data signal in the period in which the precharge voltage and the second selecting voltage are supplied is supplied both in the first half and in the second half of the second horizontal period by the data signal drive circuit by timing based on a cycle of one horizontal period while its polarity about the middle value is maintained. Therefore, the potential difference between the opposite ends of the two-terminal type non-linear element and the liquid crystal is increased to further promote overcharging of the liquid crystal according to the data signal for controlling the grayshade of the pixel and to limit discharging of the overcharge voltage. As a result, the liquid crystal is maintained in the above-described sufficiently charged state, thus effecting high-contrast display.

The same processing as that described above is performed with respect to all the scanning lines and data lines corresponding to selected pixel regions, so that a uniform and high-contrast display is made on the liquid crystal display panel.

The two-terminal type non-linear element may be a metal insulator metal (MIM) element, for example. The liquid crystal display panel has a MIM element, in particular, and the above-described scanning signal and data signal are controlled by the above-described driving apparatus of the present invention, so that a video signal in a system having a larger number of scanning lines can be suitably displayed while a reduction in contract is limited.

A liquid crystal display apparatus of the invention may include the above-described apparatus for driving a liquid crystal display panel, and the liquid crystal display panel. The liquid crystal display panel has a two-terminal type non-linear element, in particular, and the above-described scanning signal and data signal are controlled by the above-described driving apparatus of the present invention, so that a video signal in a system having a larger number of scanning lines can be suitably displayed while a reduction in contrast is limited.

The invention may also comprise an electronic apparatus arranged to solve the above-described problem and include the above-described liquid crystal display apparatus. The electronic apparatus has a comparatively simple arrangement that enables a video signal in a system having a larger number of scanning lines to be suitably displayed while a reduction in contrast is limited.

A method of driving a liquid crystal display panel is arranged to solve the above described problem and includes a liquid crystal display apparatus in which a plurality of scanning lines to which a scanning signal is applied and a plurality of data lines to which a data signal is applied are arranged so as to form a matrix, the liquid crystal display apparatus having a plurality of pixels each formed of a liquid crystal and a two-terminal type non-linear element connected in series between the plurality of scanning lines and the plurality of data lines, including:

forming a scanning signal having a charging mode and a discharging mode, the charging mode having a first selecting voltage which makes the two-terminal type non-linear element conductive, the discharging mode having a precharge voltage which makes the two-terminal type non-linear element conductive and which is opposite in polarity to the first selecting voltage about a middle value of the data signal, and a second selecting voltage which is output subsequently to the precharge voltage and which is opposite in polarity to the precharge voltage about the middle value, supplying the first selecting voltage of the charging mode in a first horizontal period, supplying the precharge voltage of the discharging mode in a first half of a second horizontal period one vertical period after the first horizontal period mentioned, and supplying the second selecting voltage of the discharging mode in a second half of the second horizontal period; and supplying, by timing based on a cycle of one horizontal period, the data signal for controlling a display gray scale of the pixels in the period through which the first selecting voltage is supplied in the charging mode, and also supplying, by timing based on a cycle of one horizontal period, the data signal both in the first half and in the second half of the second horizontal period in which the precharge voltage and the second selecting voltage are supplied in the discharging mode.

According to the method of driving a liquid crystal display panel, when, in the first horizontal period, the first selecting voltage is supplied in the charging mode as a scanning signal to one of the plurality of scanning lines by the scanning signal drive circuit, a data signal for controlling a grayshade of one of the pixels is supplied to the corresponding data line at least in the first horizontal period by the data signal drive circuit. A voltage corresponding to the difference between the voltage value of the data signal and the value of the first selecting voltage of the scanning signal is thereby generated between the opposite ends of the two-terminal type non-linear element and the liquid crystal to make the two-terminal type non-linear element conductive, thereby charging the liquid crystal.

Next, in the discharging mode forming a scanning signal in combination with the charging mode, the precharge voltage opposite in polarity to the first selecting voltage about the middle value of the data signal, and the second selecting voltage which is output subsequently to the precharge voltage and which is opposite in polarity to the precharge voltage about the middle value are supplied to the scanning line by the scanning line drive circuit. The precharge voltage is supplied in the first half of the second horizontal period one vertical period after the first horizontal period, a voltage corresponding to the difference between the voltage value of the data signal and the voltage value of the overcharging mode signal is generated, and the two-terminal type non-linear element becomes conductive, thereby overcharging the liquid crystal. The subsequent second selecting voltage is supplied in the second half of the second horizontal period after one vertical period to perform discharging of the overcharged voltage across the liquid crystal layer according to the voltage value corresponding to the difference between the voltage value of the data signal and the value of the second selecting voltage. The data signal in which the precharge voltage and the second selecting voltage are supplied is supplied both in the first half and in the second half of the second horizontal period by the data signal drive circuit by timing based on a cycle of one horizontal period while its polarity about the middle value is maintained. Therefore, the potential difference between the opposite ends of the two-terminal type non-linear element and the liquid crystal is increased to further promote overcharging of the liquid crystal according to the data signal for controlling the grayshade of the pixel and to limit discharging of the overcharge voltage. As a result, the liquid crystal is maintained in the above-described sufficiently charged state, thus effecting a high-contrast display.

The same processing as that described above is performed with respect to all the scanning lines and data lines corresponding to selected pixel regions, so that a uniform and high-contrast display is made on the liquid crystal display panel. The above-described operation and these and other advantages of the present invention will become apparent from embodiments of the present invention which will next be described.

BRIEF DESCRIPTION OF THE DRAWINGS

FIG. 8(A) shows voltage values of a data signal supplied to data line Xi and supply timing;

FIG. 8(B) shows voltage values of a scanning signal supplied to scanning line Yj−1 and supply timing;

FIG. 8(C) shows voltage values of a scanning signal supplied to scanning line Yj and supply timing; and FIG. 8(D) shows values of the voltage applied between the opposite ends of the MIM driving element and the liquid crystal layer and timing of changes in the voltage value.

FIG. 16(A) shows voltage values of a data signal supplied to data line Xi and supply timing;

FIG. 16(B) shows voltage values of a scanning signal supplied to scanning line Yj and supply timing; and FIG. 16(C) shows values of the voltage applied between the opposite ends of the MIM element and the liquid crystal layer and timing of changes in the voltage value.

FIG. 17(A) shows voltage values of a data signal supplied to data line Xi and supply timing;

FIG. 17(B) shows voltage values of a scanning signal supplied to scanning line Yj−1 and supply timing;

FIG. 17(C) shows voltage values of a scanning signal supplied to scanning line Yj and supply timing; and FIG. 17(D) shows values of the voltage applied between the opposite ends of the MIM element and the liquid crystal layer and timing of changes in the voltage value.

FIG. 18(A) shows voltage values of a data signal supplied to data line Xi and supply timing;

FIG. 18(B) shows voltage values of a scanning signal supplied to scanning line Yj−1 and supply timing;

FIG. 18(C) shows voltage values of a scanning signal supplied to scanning line Yj and supply timing; and FIG. 18(D) shows values of the voltage applied between the opposite ends of the MIM element and the liquid crystal layer and timing of changes in the voltage value.

DETAILED DESCRIPTION OF PREFERRED EMBODIMENTS

Embodiments of the present invention will be described below with reference to the drawings.

(MIM Element)

Figure 1:
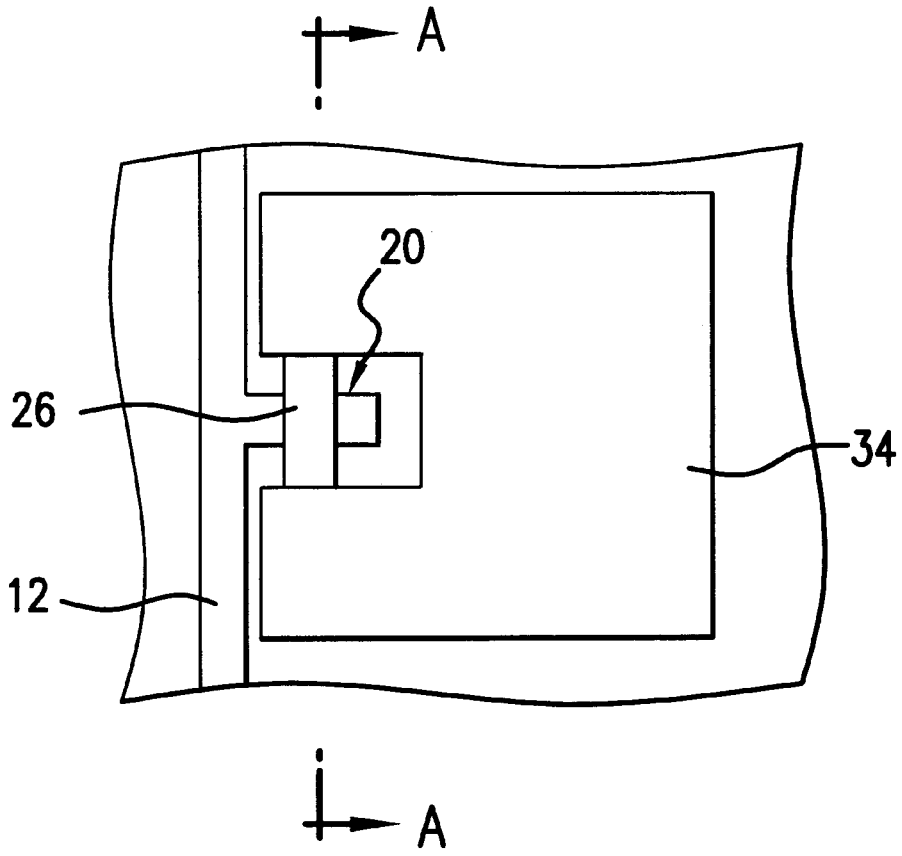
FIG. 1 is a plan view of an example of a MIM element provided in an embodiment of a liquid crystal display panel in accordance with the present invention, shown with a pixel electrode.
Figure 2:
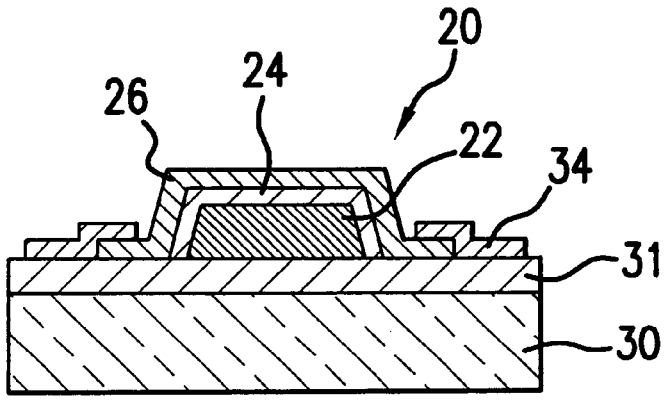
FIG. 2 is a cross-sectional view taken along line A—A of FIG. 1.

FIG. 1 is a plan view schematically showing a MIM element, which is an example of a two-terminal type non-linear element provided in a liquid crystal display panel constituting a liquid crystal display apparatus which represents an embodiment of the present invention, the MIM element being illustrated together with a pixel electrode. FIG. 2 is a cross-sectional view taken along the line A—A of FIG. 1. In FIG. 2, layers and elements are illustrated on different scales by selecting the sizes thereof such that each layer or member is recognizable in the figure.

Referring to FIGS. 1 and 2, a MIM element 20 is formed on a base which is an insulating film 31 formed on a MIM array substrate 30, which constitutes an example of a first substrate. The MIM element 20 is constituted of a first metal film 22, an insulating layer 24 and a second metal film 26, the first metal film 22, the insulating layer 24 and the second metal film 26 being formed in this order from the insulating film 31 side. Thus, the MIM element 20 has a MIM structure (metal insulator metal structure). The first metal film 22 of the two-terminal type MIM element 20 is connected to a scanning line 12 formed on the MIM array substrate 30 as one of two terminals. The second metal film 26 is connected to a pixel electrode 34 as the other terminal. A data line (see FIG. 6) may be formed on the MIM array substrate 30 instead of the scanning line 12 and connected to the pixel electrode 34.

The MIM array substrate 30 is formed of a substrate having an insulating property and transparency, e.g., glass or a plastic.

The insulating film 31 provided as a base may be made of tantalum oxide, for example. The insulating film 31, however, is formed mainly for the purpose of preventing the first metal film 22 from being separated from the base by a heat treatment which is performed, for example, after deposition of the second metal film 26, and for the purpose of preventing an impurity from being diffused from the base into the first metal film 22. Therefore, if the MIM array substrate 30 is formed of a substrate excellent in heat resistance and in purity, e.g., a quartz substrate, then the above-mentioned separation and diffusion of an impurity from the substrate are negligible.

The first metal film 22 is formed of a conductive thin film of a metal, e.g., tantalum or a tantalum alloy. Alternatively, it may be made of a material containing tantalum or a tantalum alloy as a main constituent with addition of an element belonging to group VI, VII, or VIII in the periodic table, e.g., tungsten, chromium, molybdenum, rhenium, yttrium, lanthanum, or dysprosium. In such a case, tungsten is preferred as an added element and, preferably, the content of the added element is 0.1 to 6 atomic percent, for example.

The insulating film 24 is formed of an oxide film which may be formed on the surface of the first metal film 22 by anodizing in a chemical synthesis solution.

The second metal film 26 is formed of a conductive thin film of a metal, e.g., chromium simple or a chromium alloy.

The pixel electrode 34 is formed of a transparent conductive material, e.g., ITO (indium tin oxide).

Figure 3:
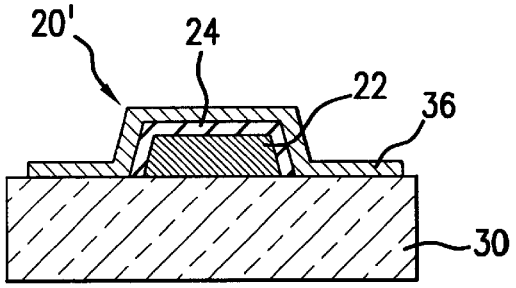
FIG. 3 is a cross-sectional view of another example of the MIM element provided in the embodiment of the liquid crystal display panel.

As shown in the cross-sectional view of FIG. 3, the above-described second metal film and pixel electrode may alternatively be formed from the same transparent conductive film 36 formed of ITO film or the like. A MIM element 20' constructed in this manner has the advantage of having the second metal film and the pixel electrode formed by the same manufacturing step at the time of manufacturing. The same components as those shown in FIG. 2 are indicated by the same reference numerals in FIG. 3, and the description of them will not be repeated.

Figure 4:
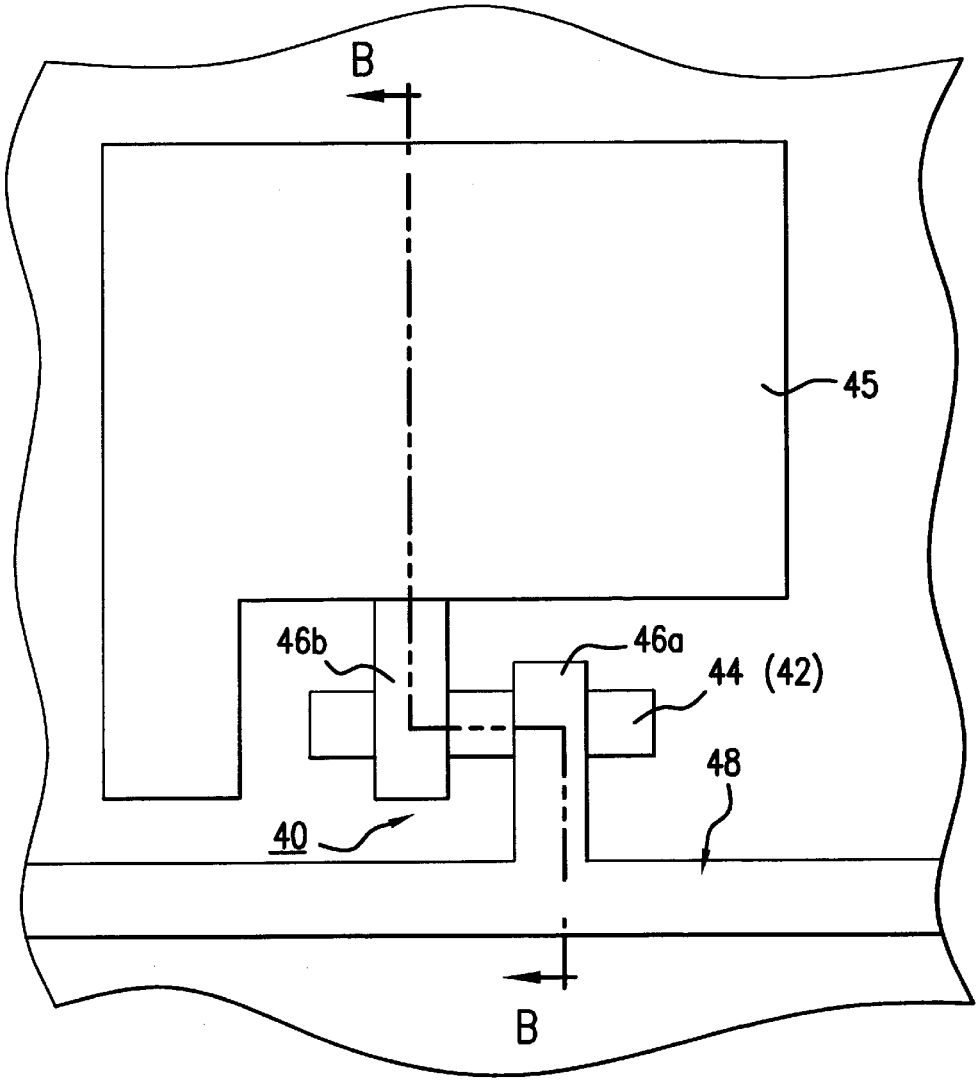
FIG. 4 is a cross-sectional view of still another example of the MIM element provided in the embodiment of the liquid crystal display panel, shown with a pixel electrode.
Figure 5:
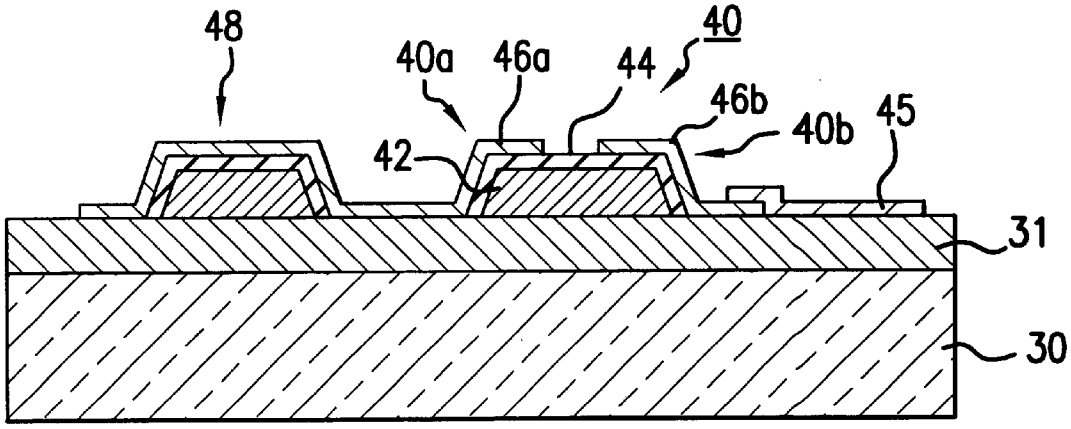
FIG. 5 is a cross-sectional view taken along line A—A of FIG. 4.

Further, as shown in the plan view of FIG. 4 and the B—B cross-sectional view of FIG. 5, a MIM element 40 may be constructed so as to have a so-called back to back structure, i.e., a structure in which a first MIN element 40*a* and a second MIM element 40*b* are connected in series while being reversed in polarity relative to each other. The same components as those shown in FIG. 2 are indicated by the same reference numerals in FIGS. 4 and 5, and the description of them will not be repeated.

Referring to FIGS. 4 and 5, the first MIM element 40*a* is formed on a base which is an insulating film 31 formed on a MIM array substrate 30. The first MIM element 40*a* is constituted of a first metal film 42 formed of tantalum or the like, an insulating film 44 formed of an anodized film or the like, and a second metal film 46*a* formed of chromium or the like, the first metal film 42, the insulating film 44 and the second metal film 46*a* being successively formed in this order on the insulating film 31. On the other hand, the second MIM element 40*b* is formed on the base which is the insulating film 31 formed on the MIM array substrate 30. The second MIM element 40*b* is constituted of the first metal film 42, the insulating film 44, and a second metal film 46*b* separate from the second metal film 46*a*.

The second metal film 46*a* of the first MIM element 40*a* is connected to a scanning line 48 while the second metal film 46*b* of the second MIM element 40*b* is connected to a pixel electrode 45 formed of an ITO film or the like. Therefore, a scanning signal is supplied from the scanning line 48 to the pixel electrode 45 via the first and second MIM elements 40*a* and 40*b*. A data line (see FIG. 6) may be formed on the MIM array substrate 30 instead of the scanning line 48 and connected to the second metal film 46*a* of the first MIM element 40*a*.

In the example shown in FIGS. 4 and 5, the insulating film 44 is reduced in thickness relative to the insulating film 24 in the example shown in FIGS. 1 and 2. For example, the thickness of the insulating film 44 is set to about half the thickness of the insulating film 24.

While examples of the MIM element have been described as a two-terminal type non-linear element, a two-terminal type non-linear element having a bidirectional diode characteristic, e.g., a ZnO (zinc oxide) varistor, a MIS (metal semi-insulator) element, or an RD (ring diode) may be applied to the active matrix drive type of liquid crystal display panel of this embodiment.

(Liquid Crystal Display Panel)

Figure 6:
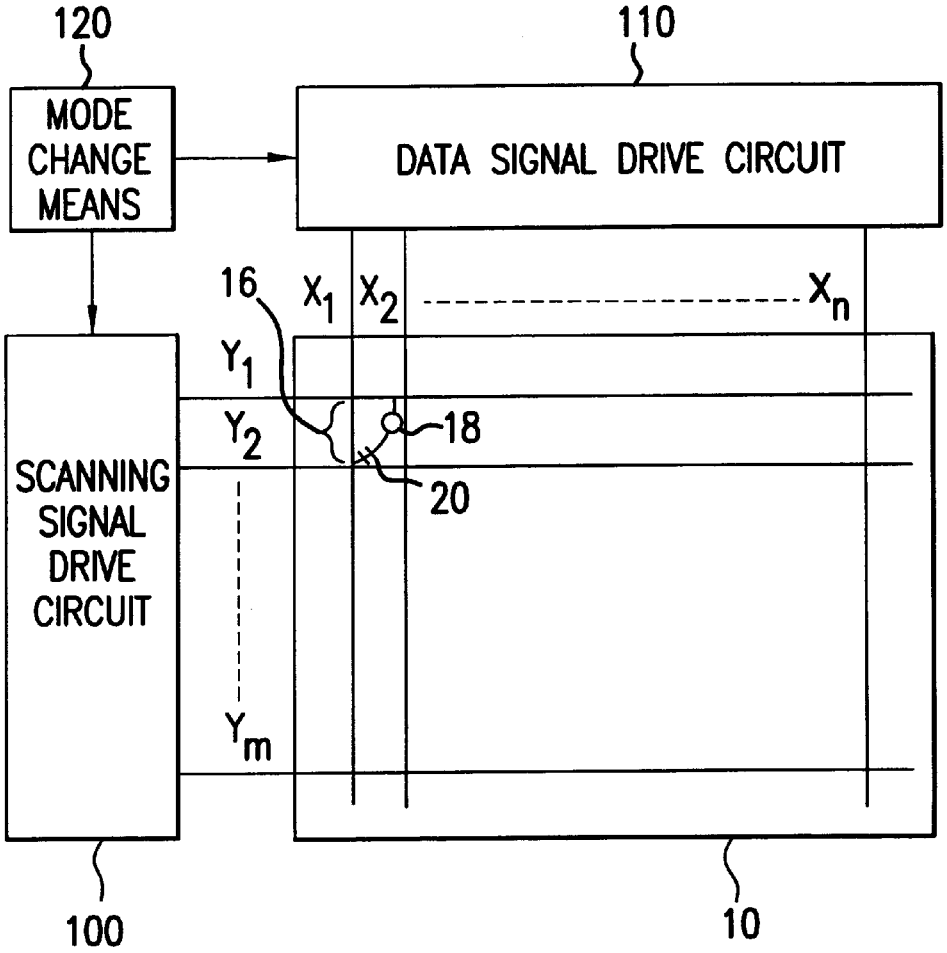
FIG. 6 is an equivalent circuit diagram showing a circuit constituting an embodiment of the liquid crystal display panel.
Figure 7:
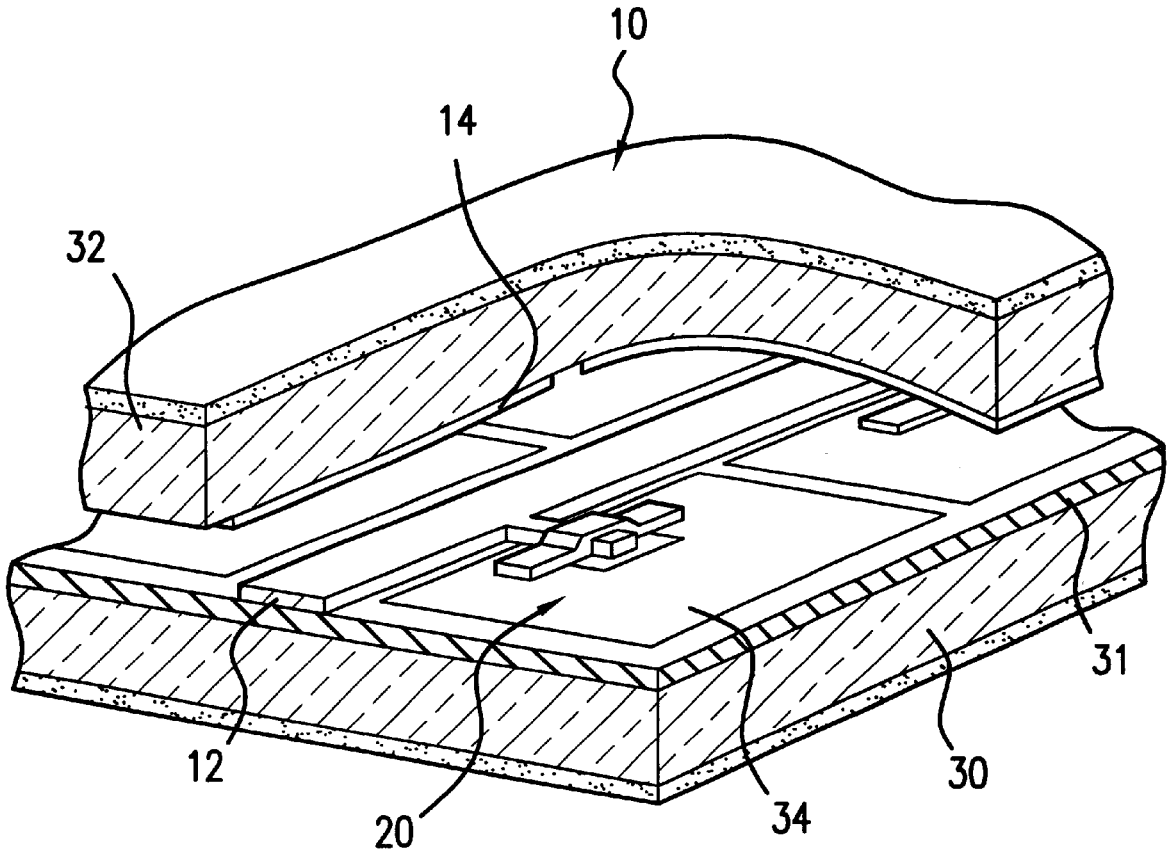
FIG. 7 is a schematic partially cutaway perspective view of the embodiment of the liquid crystal display panel.

An embodiment of the active matrix drive type of liquid crystal display panel using the above-described MIM element 20 will next be described with reference to FIGS. 6 and 7. FIG. 6 is an equivalent circuit diagram in which the liquid crystal display panel of this embodiment is shown together with a drive circuit, and FIG. 7 is a schematic partially cutaway perspective view of the liquid crystal display panel in this embodiment.

Referring to FIG. 6, in a liquid crystal display panel 10, a plurality of scanning lines Y1 to Ym arranged on a MIM array substrate 30 or a substrate opposed to the MIM array substrate 30 are connected to a scanning signal drive circuit 100 while a plurality of data lines X1 to Xn arranged on the MIM array substrate 30 or the substrate opposed to the MIM array substrate 30 are connected to a data signal drive circuit 110. Further, a mode change means 120 which outputs a mode change signal necessary for driving the liquid crystal display panel 10 by the charge and discharge drive method is connected to each of the scanning signal drive circuit 100 and the data signal drive circuit 110. The scanning signal drive circuit 100, the data signal drive circuit 110 and the mode change means 120 may be formed on the MIM array substrate 30 shown in FIGS. 1 and 2 or the substrate opposed to the MIM array substrate 30. In such a case, a liquid crystal display apparatus (liquid crystal display panel) including drive circuits is formed. Alternatively, the scanning signal drive circuit 100, the data signal drive circuit 110 and the mode change means 120 may be formed of ICs independent of the liquid crystal display panel and may be connected to the scanning lines Y1 to Ym and the data lines X1 to Xn via a predetermined wiring. In such a case, a liquid crystal display apparatus (liquid crystal display module) including no drive circuits is formed.

In each of pixel regions 16, one of the scanning lines Y1 to Ym is connected to one terminal of the MIM element 20 (see FIG. 1) while one of data lines X1 to Xn is connected to the other terminal of the MIM element 20 via the liquid crystal layer 18 and the pixel electrode 34 shown in FIG. 1. Therefore, when a scanning signal is supplied to one of the scanning lines Y1 to Ym corresponding to each pixel region 16 and when a data signal is supplied to the corresponding one of the data lines X1 to Xn, the MIM element in the pixel region is turned on and a drive voltage is applied to the liquid crystal layer 18 between the pixel electrode 34 and the corresponding one of the data lines X1 to Xn through the MIM element 20.

The arrangement in which the scanning signal drive circuit 100, the data signal drive circuit 110 and the mode change means 120 are provided on the MIM array substrate 30 is advantageous in that the thin-film forming process for the MIM elements 20 and the thin-film forming process for the scanning signal drive circuit 100, the data signal drive circuit 110 and the mode change means 120 can be performed simultaneously. However, the facility with which the liquid crystal display panel 10 is manufactured and the adaptability of the construction of the apparatus can be improved if an arrangement is adopted in which the scanning lines Y1 to Ym and the data lines X1 to Xn are connected, through an anisotropic conductive film provided on a peripheral portion of the MIM array substrate 30, to an LSI which includes the scanning signal drive circuit 100 and the data signal drive circuit 110 mounted by the TAB (tape automated bonding) method. If an arrangement is adopted in which LSIs which include the scanning signal drive circuit 100 and the data signal drive circuit 110 are mounted on the MIM array substrate 30 and an opposed substrate 32 by the COG (chip on glass) method, the liquid crystal display panel 10 can be manufactured with further improved facility and can be improved in reliability, the construction of the apparatus can also be simplified and the facility of assembly can be improved.

Referring to FIG. 7, the liquid crystal display panel 10 has the MIM array substrate 30 and the opposed substrate 32, which is opposed to the MIM array substrate 30, and which constitutes an example of a second transparent substrate. The opposed substrate 32 is formed of a glass substrate, for example. On the MIM array substrate 30, a plurality of transparent pixel electrodes 34 are arrayed in a matrix form. The plurality of transparent pixel electrodes 34 extend along a predetermined X-direction and are respectively connected to the plurality of scanning lines Y1 to Ym arranged in a Y-direction perpendicular to the X-direction. An alignment layer formed of an organic thin film, e.g., a polyimide thin film, and treated by a predetermined orientation treatment such as rubbing, is provided on the surfaces of the pixel electrodes 34, the MIM element 20 and the scanning lines Y1 to Ym facing a liquid crystal.

On the other hand, the plurality of data lines X1 to Xn in the form of strips extending along the Y-direction and arranged in the X-direction are provided on the opposed substrate 32. An alignment layer formed of an organic thin film, e.g., a polyimide thin film and treated by a predetermined orientation treatment such as rubbing is provided under the data lines X1 to Xn. In this case, the data lines X1 to Xn, at least its portions facing the pixel electrodes 34, are formed of a transparent conductive film such as an ITO film. However, if the scanning lines Y1 to Ym are formed on the opposed substrate 32 side in place of the data lines X1 to Xn, the scanning lines Y1 to Ym are formed of a transparent conductive film such as an ITO film.

On the opposed substrate 32, a color filter formed of films of coloring materials arrayed in a striped, mosaic or triangular form, for example, may be provided on the opposed substrate 32 according to use of the liquid crystal display panel 10. Further, a black matrix formed of, for example, a metallic material such as chromium or nickel, a resin black prepared by dispersing carbon or titanium in a photoresist, or the like may also be provided. Such a color filter and a black matrix enable color display on one liquid crystal display panel, and enable a high-quality image display by certain effects such as an effect of improving contrast and an effect of preventing color mixing of coloring materials.

Between the MIM array substrate 30 and the opposed substrate 32 thus constructed and positioned so that the pixel electrodes 34 and the data lines X1 to Xn are opposed to each other, a liquid crystal is enclosed in a space surrounded by a sealing material provided along peripheral portions of the opposed substrate 32, thus forming a liquid crystal layer 18 (see FIG. 6). The liquid crystal layer 18 is set in a predetermined orientated state by the above-described alignment layers when no electric field is applied from the pixel electrodes 34 and the data lines X1 to Xn. For example, the liquid crystal layer 18 is formed of a liquid crystal which is formed of one nematic liquid crystal or in which a plurality of kinds of nematic liquid crystals are mixed. The sealing material is an adhesive for bonding peripheral portions of the two substrates 30 and 32 to each other. Spacers for setting the distance between the two substrates to a predetermined value are mixed in the sealing material.

Referring to FIG. 6, as the scanning signal drive circuit 100 supplies pulse-like scanning signals having predetermined voltages to the MIM elements 20 one after another, the data signal drive circuit 110 supplies data signals having pulse widths corresponding to gray scale levels of display signals to data lines 14 one after another in synchronization with the supply of the scanning signals from the scanning signal drive circuit 100, as described below. Referring to FIG. 7, when voltages are applied to the pixel electrodes 34 and the data lines 14 in this manner, the oriented state of each of the portions of the liquid crystal layer between the pixel electrodes 34 and the data lines X1 to Xn is changed by the drive voltage applied through the MIM element 20. In the case of a normally white mode, incident light is stopped from passing through the liquid crystal portion when the drive voltage is being applied. In the case of a normally black mode, incident light is allowed to pass through the liquid crystal portion when the drive voltage is being applied. As a result, light emerges out of the entire liquid crystal display panel 10 with a contrast effect in accordance with the display signals.

On each of the surface of the opposed substrate 32 through which projected light is introduced and the surface of the MIM array substrate 30 from which projected light emerges, a polarizing film, a phase difference film, a polarizing plate or the like may be placed in a predetermined direction according to the kind of operation mode, such as a TN (twisted nematic) mode, an STN (super-TN) mode or a D-STN (double-STN) mode, and a normally white mode or normally black mode, although these elements are not illustrated in FIGS. 1 to 7.

(Embodiment of Drive Circuit)

The configuration and operation of an embodiment of the scanning signal drive circuit 100, the data signal drive circuit 110 and the mode change means 120 shown in FIG. 6 will next be described with reference to FIGS. 8(A)–8(D) and 9(A)–9(B).

Figure 8A:
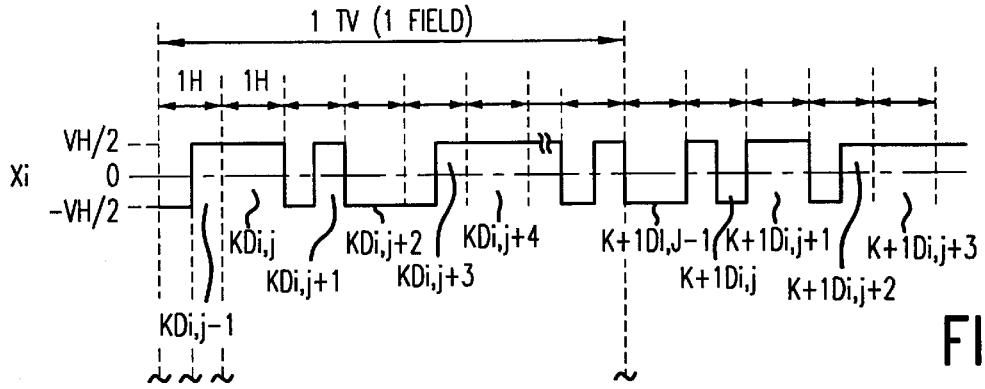
FIGS. 8(A)–8(D) are timing charts according to the charge and discharge drive method of the present invention.
Figure 8B:
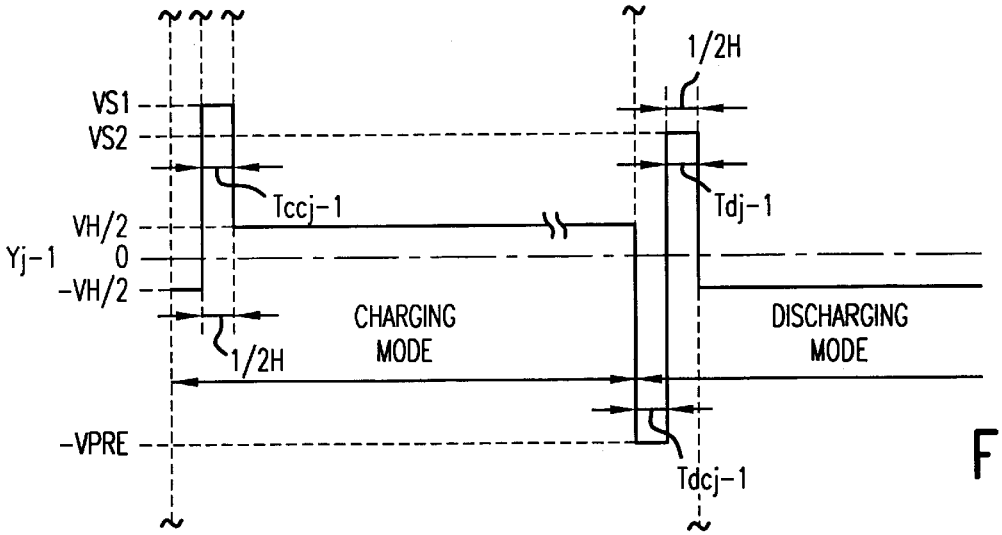
Figure 8C:
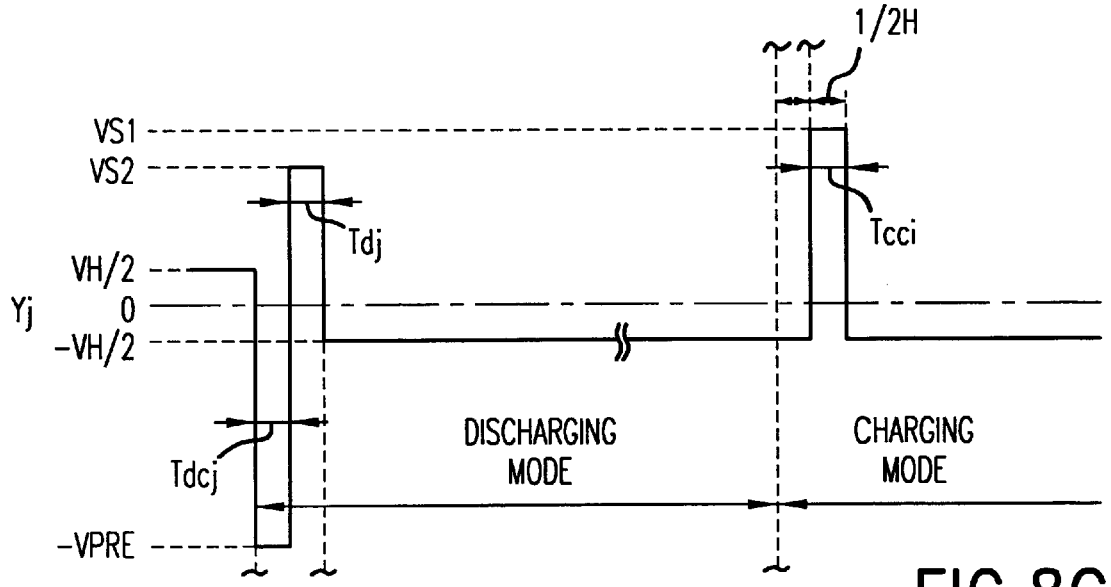

First, the scanning signal drive circuit 100 constituting an example of scanning signal drive means is arranged to form scanning signals such as those shown in FIGS. 8(B) and 8(C) having a charging mode waveform and a discharging mode waveform based on a reference clock, and to supply the scanning signals to the plurality of scanning lines Y1 to Ym one after another while changing the mode with the row change from one scanning line to another based on a mode change signal supplied from the mode change means 120. To each of the scanning lines Y1 to Ym, the scanning signal drive circuit 100 supplies the scanning signal while changing the mode with the passage of every vertical period TV based on the mode change signal. Inverting the polarity of the scanning signals (about the middle value of data signals) with the passage of every vertical period and with the row change from one scanning line to another (while inverting the data signal correspondingly) as described above is performed for the purpose of preventing deterioration of the liquid crystal layer 18 by the effect of alternate current driving of the liquid crystal layer 18. The scanning signals may be applied to the scanning lines Y1 to Ym one for each line in a time division manner or one for each of groups of the plurality of lines, e.g., three lines in a time division manner in accordance with a drive method.

Each scanning signal supplied from the scanning signal drive circuit 100 has a first selecting voltage which is set to VS1 in the charging mode, and which is supplied to one of the scanning lines Y1 to Ym in a charging period Tcc corresponding to the second half ½H of one horizontal period H. Tccj and Tccj−1 written in FIGS. 8(B) and 8(C) respectively denote the charging periods in the charging modes with respect to the scanning signals supplied to the scanning lines Yj and Yj−1.

On the other hand, in the scanning signal in the discharging mode, a precharge voltage in an overcharging period Tdc is set to−VPRE, which is opposite in polarity to the first selecting voltage (VS1) about the middle value of data signals, and a second selecting voltage in a discharging period Td, output successively, is set to VS2 having the same polarity as VS1 about the middle value of data signals and smaller in absolute value than VS1. The overcharging period Tdc of supply to each of the scanning signals Y1 to Ym is set as the first half ½H of one horizontal period H while the discharging period Td of supply to each of the scanning signals Y1 to Ym is set as the second half ½ of the one horizontal period H. Tdcj, Tdj, Tdcj−1, and Tdj−1 written in FIGS. 8(B), 8(C), and 8(D) respectively denote the overcharging and discharging periods in the discharging modes of the scanning signals supplied to the scanning lines Yj and Yj−1.

On the other hand, the data signal drive circuit 110 supplies data signals according to each mode to the data lines X1 to Xn based on the mode change signal supplied from the mode change means 120. Referring to FIG. 8(A), if, for example, a data signal is shown as kDi,j, k denotes the field number, and i and j denote the data line number and the scanning line number, respectively. Accordingly, data signal kdi,j denotes a data signal supplied to data line Xi as data for display of the kth field at the pixel region corresponding to the intersection of data line Xi and scanning line Yj.

In this embodiment, as shown in FIG. 8(A), a data signal supplied in the charging mode is supplied only in the second half ½H of one horizontal period H, i.e., only in charging period Tcc. For example, in the example shown in FIG. 8(A), data signal kdi,j−1 is a signal having a value of VH/2 and is supplied in the second half ½H of one horizontal period H. The value in the first half period ½H is −VH/2 but it is just a value maintained from the value of data signal in the preceding horizontal period. Data signal kDi,j−1 such as shown in FIG. 8(A) is supplied to data line Xi. If a scanning signal such as shown in FIG. 8(B) is supplied to scanning signal Yj−1, the voltage applied between the opposite ends of the MIM element 20 and the liquid crystal layer 18 in the pixel region corresponding to the intersection of data line Xi and scanning line Yj−1 is VS1−VH/2. Accordingly, the MIM element 20 is in the off state and the liquid crystal layer 18 is also in the off state. Consequently, white is displayed in the case of a normally white mode, or black is displayed in the case of a normally black mode.

On the other hand, with respect to the discharging mode, the arrangement is such that, both in the first half and in the second half of one horizontal scanning period, a data signal is supplied with a constant polarity, thereby ensuring that, even if the first half ½H of one horizontal period H is set as overcharging period Tdc and if the second half ½H is set as discharging period Td, overcharging can be adequately performed to avoid a reduction in contrast.

Figure 8D:
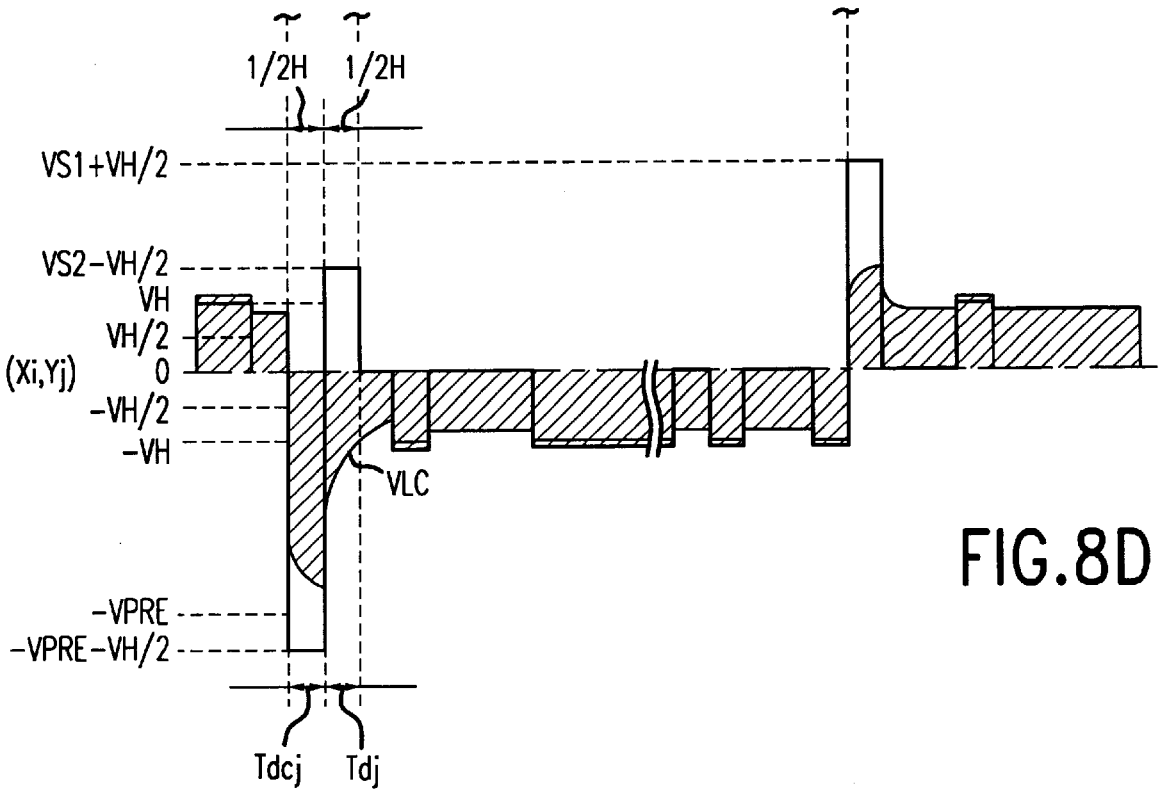
Figure 18A:
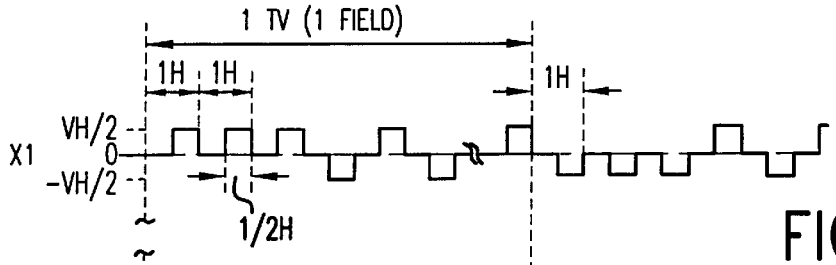
FIG.18A PRIOR ART
FIGS. 18(A)–18(D) are timing charts according to a conventional charge and discharge drive method.
Figure 18B:
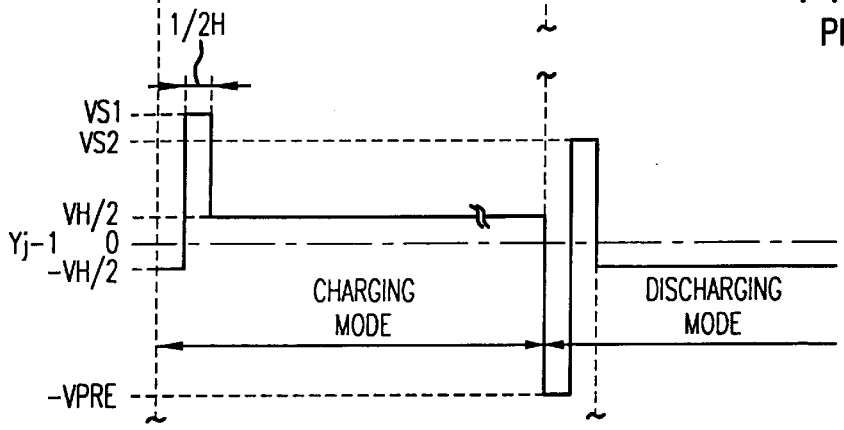
FIG.18B PRIOR ART
Figure 18C:
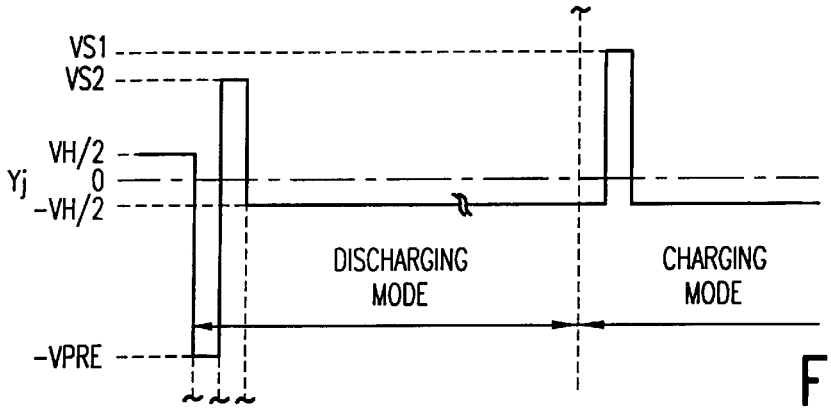
FIG.18C PRIOR ART
Figure 18D:
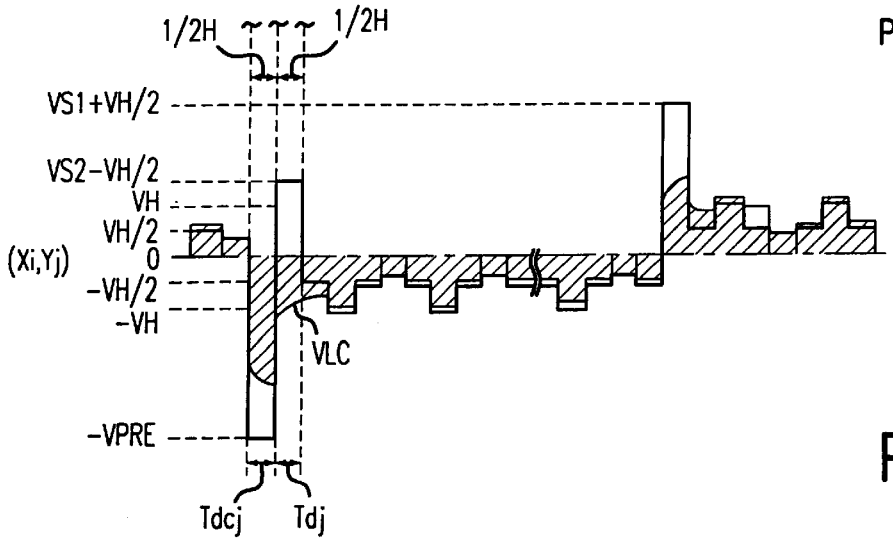
FIG.18D PRIOR ART

For example, in the example shown in FIG. 8(A), data signal kDi,j is a signal having a value of VH/2 and is supplied through one horizontal period H. If data signal kdi,j such as shown in FIG. 8(A) is supplied to data line Xi, while a scanning signal such as shown in FIG. 8(B) is supplied to scanning line Yj, the voltage applied between the opposite ends of the MIM element 20 and the liquid crystal layer 18 in the pixel region (Xi, Yj) corresponding to the intersection of data line Xi and scanning line Yj is−VPRE−VH/2 in overcharging period Tdcj, as shown in FIG. 8(D). Thus, a voltage sufficiently higher than that in the example of the conventional art shown in FIG. 18(D) can be applied between the opposite ends of the MIM element 20 and the liquid crystal layer 18, so that overcharging can be adequately performed. The MIM element 20 is thereby set in the on state. In discharging period Tdj, a voltage of VS2−VH/2 is applied, such that the amount of discharge is suitably limited, thereby maintaining the MIN element 20 in the on state. Correspondingly, the liquid crystal layer 18 is set in the on state. Consequently, black is displayed in the case of a normally white mode, or white is displayed in the case of a normally black mode.

If the voltage of data signal kdij supplied in the discharging mode is−VH/2 both in the first half and in the second half of one scanning period, the voltage in overcharging period Tdcj is−VPRE+VH/2 and overcharging cannot adequately be performed art contrast with the case where a data signal of VH/2 is supplied. However, the voltage applied to the MIM element 20 and the liquid crystal layer 18 in discharging period Tdj becomes VS2+VH/2, thereby achieving adequate discharging. As result, the MIM element 20 is set in the off state, and inadequacy of overcharging is not a problem.

The potential across the liquid crystal layer 18 in accordance with the above-described drive method is indicated by hatched areas in FIG. 8(D).

According to the present invention, as described above, overcharging can be adequately performed even if the first half ½H of one horizontal period H is set as overcharging period Tdc while the second half ½H is set as discharging period Td. Therefore, a reduction in contrast can be prevented while crosstalk of a data signal is reliably prevented.

Figure 9A:
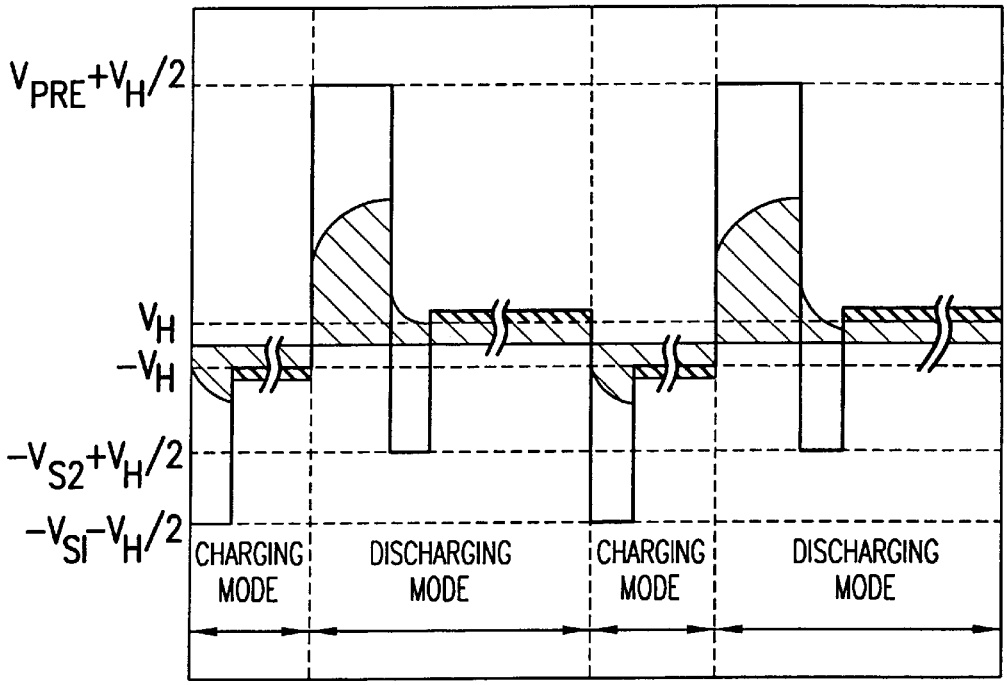
FIGS. 9(A) and 9(B) are diagrams showing other examples of the charging mode waveform and discharging mode waveform in accordance with the charge and discharge drive method of the present invention.
Figure 9B:
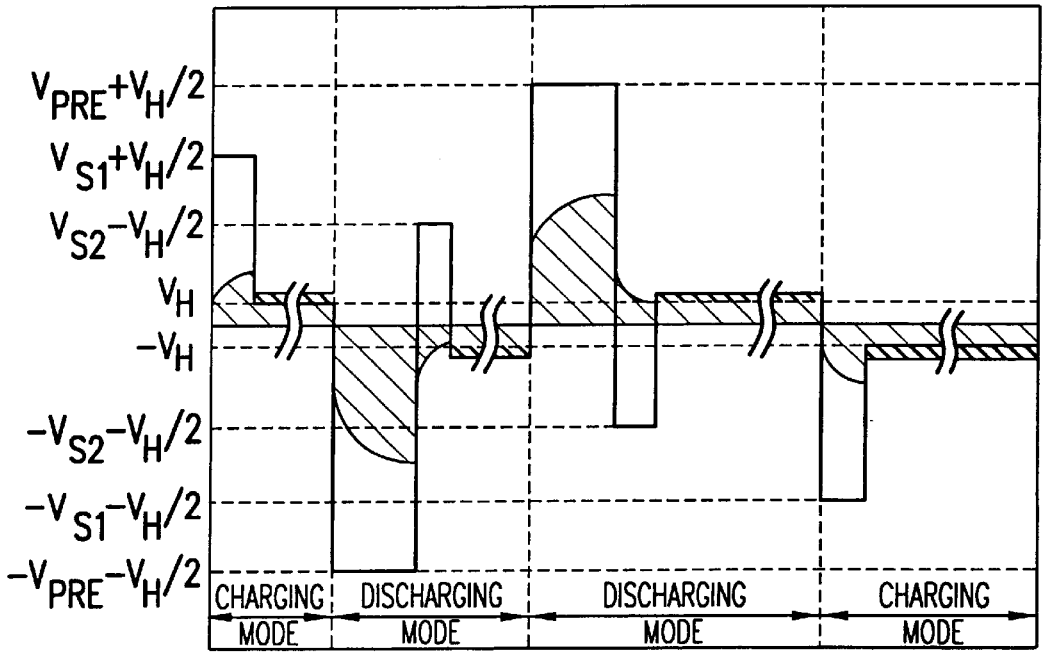

The drive waveforms of the charge and discharge drive method are not limited to those shown in FIG. 8. Those in which at least a charging mode and a discharging mode (including an overcharging period before the discharging mode) are mixed may suffice. For example, positive precharging with respect to the middle value of data signals may be performed, as shown in FIG. 9(A), and precharging with positive and negative polarities with respect to the middle value of data signals may also be performed, as shown in FIG. 9(B). Setting for such precharging can be performed by changing the timing of supply of the mode change signal from the mode change means 120.

Further, a grayshade may be displayed by pulse-height (voltage modulation) or pulse-width modulation of data signals. Also, the periods corresponding to the first and second halves of one scanning period in this embodiment are not exclusively required to be used. Also, polarity inverting drive in a cycle of n horizontal periods with respect to the middle value of data signals may be performed as well as polarity inverting drive in a cycle of one horizontal period with respect to the middle value of data signals. It is also possible to perform only frame inverting drive without performing inverting drive in a cycle of one horizontal period with respect to the middle value of data signals.

If the above-described liquid crystal display panel 10 is applied to, for example, a multicolor liquid crystal projector, three liquid crystal display panels 10 are respectively used as RGB light valves, and light of each color separated by a dichroic mirror for RGB color separation is incident upon the corresponding one of the panels. In such a case, therefore, there is no need to provide a color filter on the opposed substrate 32. If the liquid crystal display panel 10 is applied to, for example, a direct viewing or reflecting type multicolor liquid crystal television set, an RGB color filter may be formed together with a protective film on the opposed substrate 32 so as to cover predetermined regions facing the pixel electrodes 34.

In the liquid crystal display panel 10, to reduce failure of orientation of liquid crystal molecules on the MIM array substrate 30 side, the entire surfaces of pixel electrodes 34, MIM elements 20 and scanning lines 12 and so on may be covered with a flat film applied by spin coating or the like or may undergo a CMP treatment.

In the liquid crystal display panel 10, a high molecular dispersion type liquid crystal prepared by dispersing small particles of a liquid crystal in a high molecular material may be used for the liquid crystal layer 18 while the described example of the liquid crystal layer 18 is formed of a nematic liquid crystal. In such a case, the need for the above-mentioned alignment layer, polarizing film, polarizing plate or the like can be eliminated to improve the light utilization efficiency, so that the liquid crystal display panel has the advantage of an increased luminance and reduced power consumption. Further, if the liquid crystal display panel 10 is applied to a reflection type liquid crystal display apparatus by forming pixel electrodes 34 of a metal such as Al having a high reflectance, an SH (super homeotropic) type liquid crystal or the like, having liquid crystal molecules oriented generally vertically when no voltage is applied to it, may be used. Also in the liquid crystal display panel 10, data lines 14 are provided on the opposed substrate 32 side to apply an electric field perpendicular to the liquid crystal layer (perpendicular electric field). However, the arrangement may alternatively be such that pixel electrodes 34 are extended from a pair of electrodes for generating a lateral electric field such that an electric field (lateral electric field) parallel to the liquid crystal layer is applied to the liquid crystal layer (that is, electrodes for generating a lateral electric field are provided on the MIM array substrate 30 side while no electrode for generating a perpendicular electric field is provided on the opposed substrate 32 side). A display panel using a lateral electric field in this manner is advantageous in increasing the viewing angle in comparison with one using a perpendicular electric field. This embodiment can also be applied with other various liquid crystal materials (liquid crystal phases), operation modes, liquid crystal orientations, drive methods and so on.

(Electronic Apparatus)

An embodiment of an electronic apparatus having the liquid crystal display panel 10, scanning signal drive circuit 100 and data signal drive circuit 110 described above in detail will next be described with reference to FIGS. 10 to 14.

Figure 10:
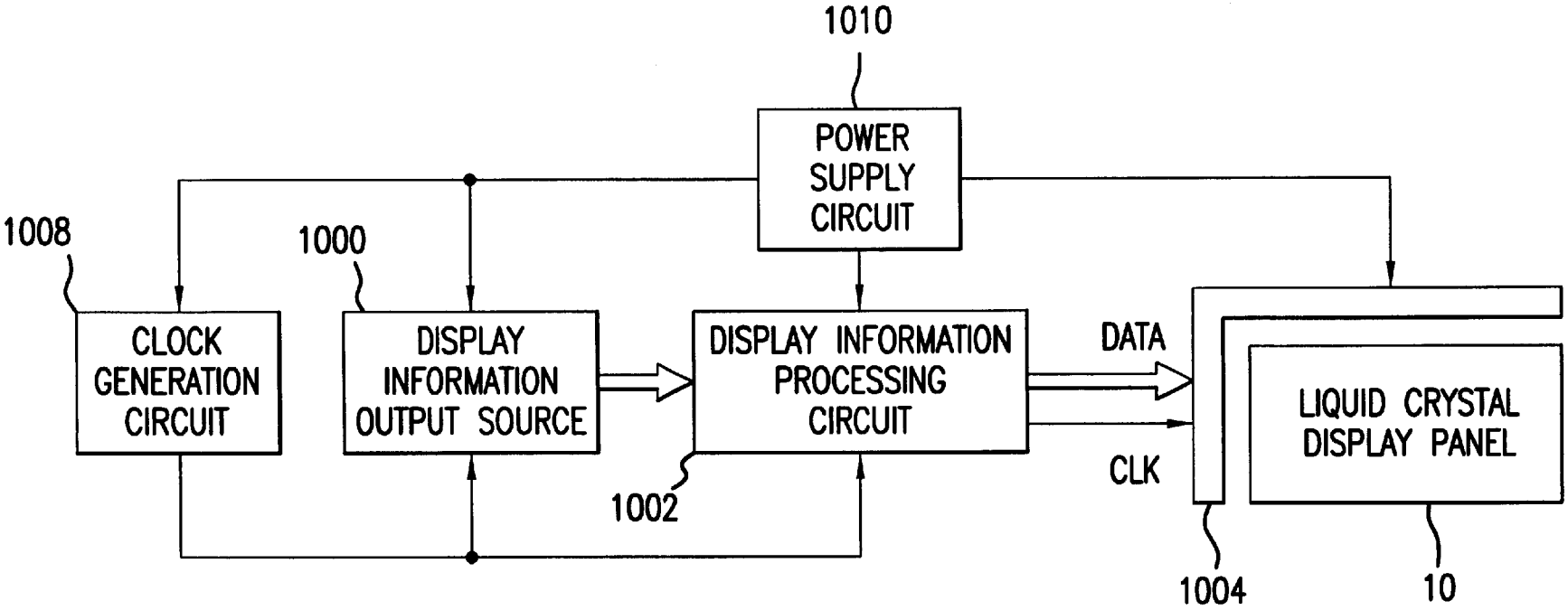
FIG. 10 is a block diagram showing an embodiment of an electronic apparatus in accordance with the present invention.

FIG. 10 schematically shows the configuration of the electronic apparatus provided with the liquid crystal display panel 10 and so on in the above-described manner.

Referring to FIG. 10, the electronic apparatus has a display information output source 1000, a display information processing circuit 1002, a drive circuit 1004, which includes the above-described scanning signal drive circuit 100 and data signal drive circuit 110, the above-described liquid crystal display panel 10, a clock generation circuit 1008 and a power supply circuit 1010. The display information output source 1000 comprises memories, such as a ROM (read only memory), a RAM (random access memory), an optical disk unit, and a tuning circuit. The display information output source 1000 outputs display information, such as a video signal of a predetermined format, to the display information processing circuit 1002 based on a clock from the clock generation circuit 1008. The display information processing circuit 1002 comprises various well-known processing circuits, such as an amplification and polarity inverting circuit, a phase development circuit, a rotation circuit, a gamma correction circuit, and a clamp circuit. The display information processing circuit 1002 generates 64-gradation digital signals DATA (D0 to D5) one after another from display information, which is input based on the clock, and outputs the data signals to the drive circuit 1004 together with a clock CLK. The drive circuit 1004 drives the liquid crystal display panel 10 by the scanning signal drive circuit 100 and the data signal drive circuit 110 based on the above-described drive method. The power supply circuit 1010 supplies predetermined power to each of the above-described circuits. The drive circuit 1004 may be mounted on the MIM array substrate constituting the liquid crystal display panel 10. The display information processing circuit 1002 may also be mounted together with the drive circuit 1004.

Figure 11:
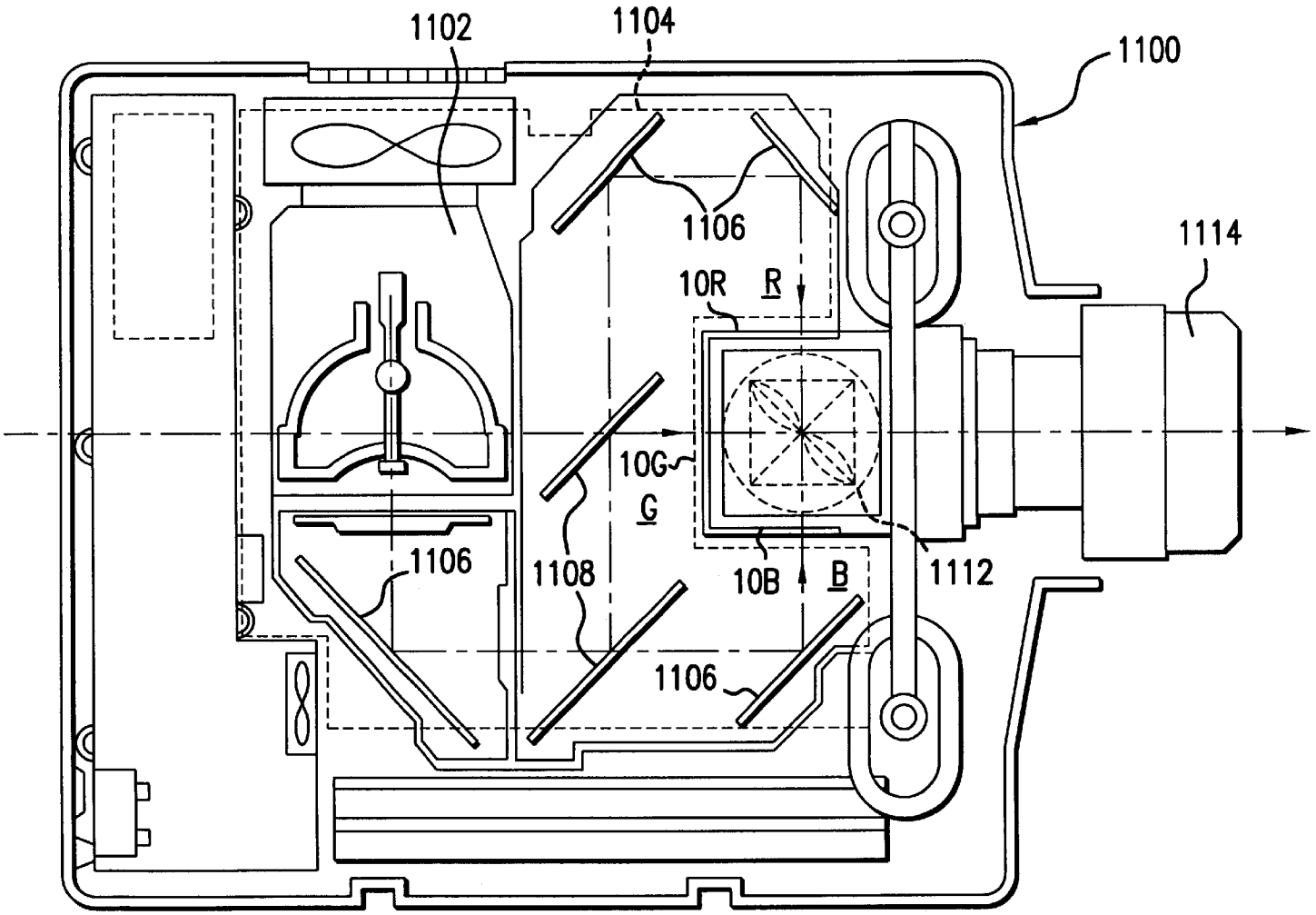
FIG. 11 is a cross-sectional view of a liquid crystal projector, which is an example of the electronic apparatus.
Figure 12:
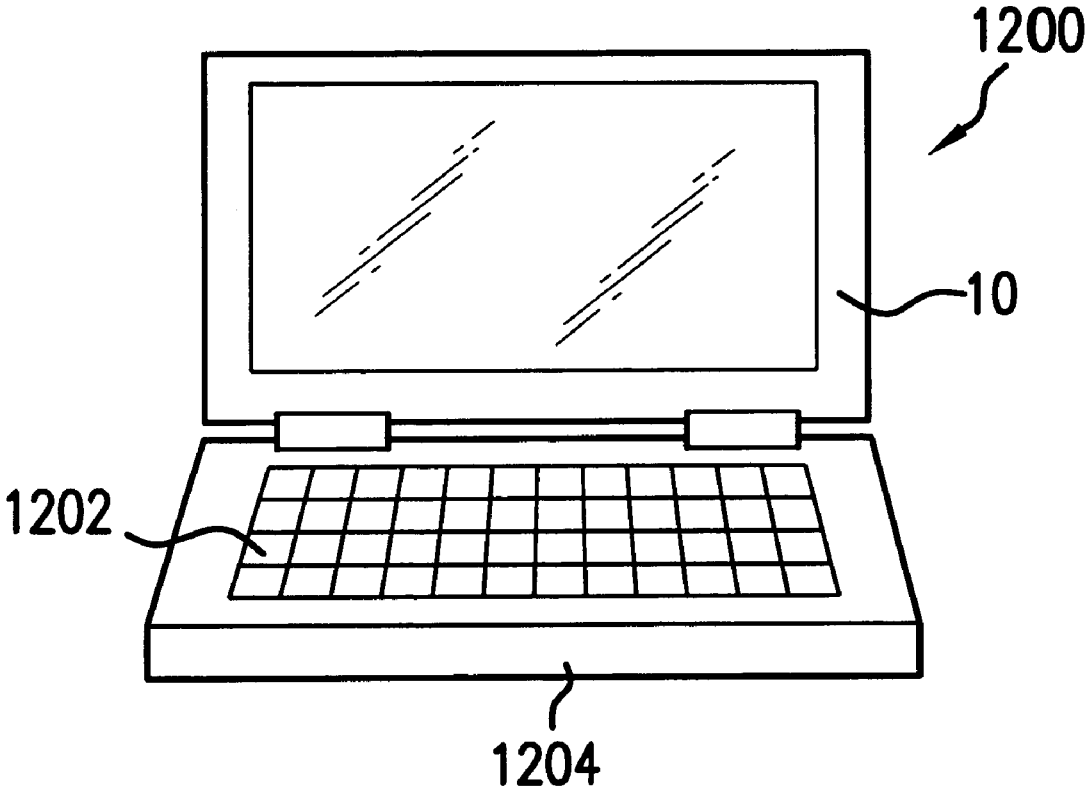
FIG. 12 is a cross-sectional view of a personal computer, which is an example of the electronic apparatus.

FIGS. 11 and 12 respectively show concrete examples of the thus-arranged electronic apparatus.

Referring to FIG. 11, a liquid crystal projector 1100, which is an example of the electronic apparatus, is constructed as a type of projector such that three liquid crystal display modules each including a liquid crystal display panel 10 in which the above-described drive circuit 1004 is mounted on the MIM array substrate are prepared and respectively used as RGB light valves 10R, 10G, and 10B. In the liquid crystal projector 1100, projection light is emitted from a lamp unit 1102 provided as a white light source. Traveling via a plurality of mirrors 1106 in a light guide 1104, the emitted light is separated into light components R, G, and B corresponding to the three primary colors RGB by two dichroic mirrors 1108. These light components are respectively led to the light valves 10R, 10G, and 10B corresponding to the colors. The light components corresponding to the three primary colors, respectively modulated by the light valves 10R, 10G, and 10B are recombined by a dichroic prism 1112, and the combined light is projected as a multicolor image onto a screen or the like through a projection lens 1114.

Referring to FIG. 12, a laptop type personal computer 1200, which is another example of the electronic apparatus, has the above-described liquid crystal display panel 10 provided in a top cover case, and has a main body 1204 in which a CPU, a memory, a modem and so on are accommodated, and in which a keyboard 1202 is incorporated.

Figure 13:
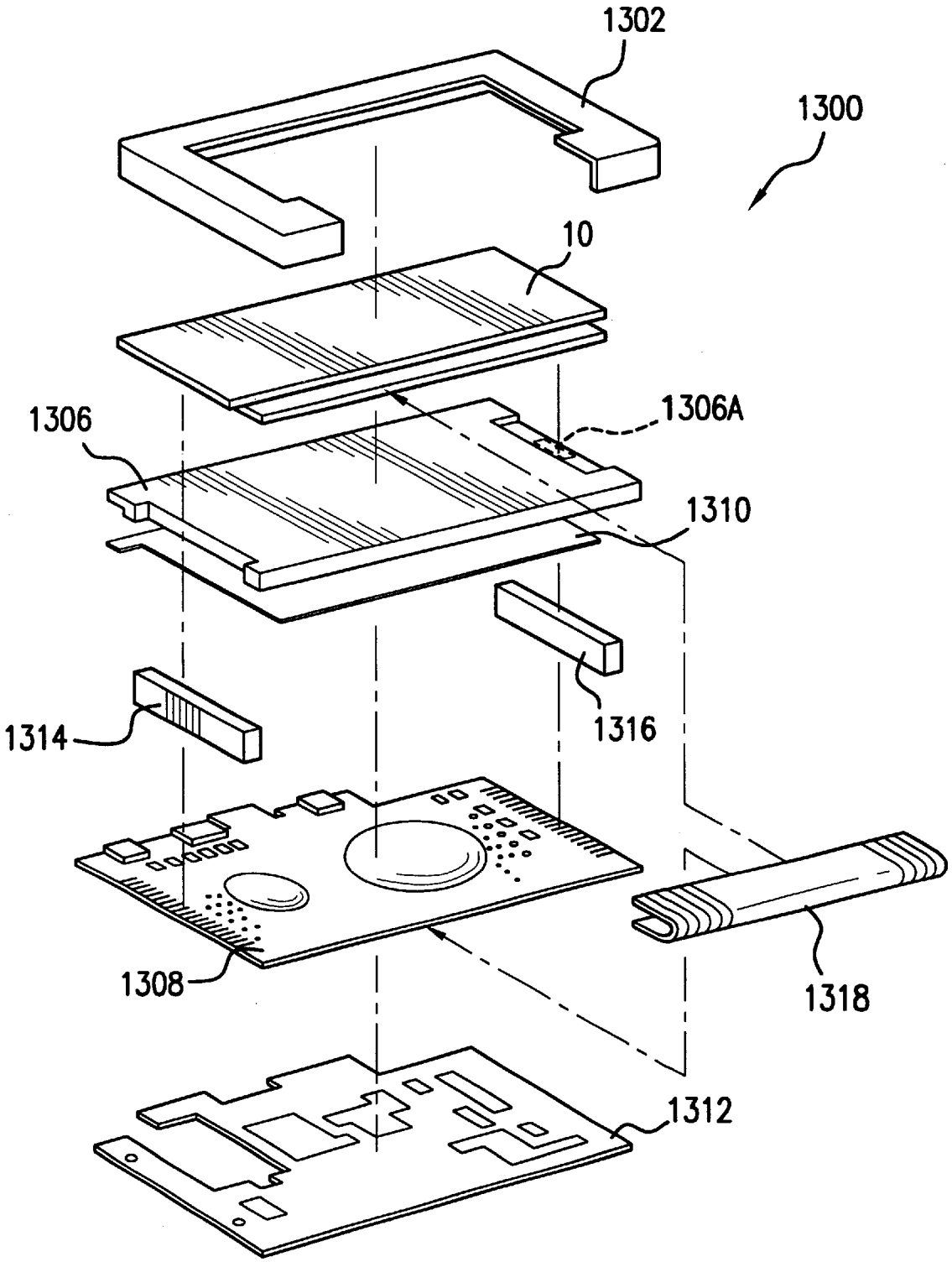
FIG. 13 is a cross-sectional view of a pager, which is an example of the electronic apparatus.

Referring to FIG. 13, a pager 1300, which is still another example of the electronic apparatus, has a metallic frame 1302 in which a liquid crystal display panel 10 having the above-described drive circuit 1004 mounted on the MIM array substrate and forming a liquid crystal display module is accommodated together with a light guide 1306 including a backlight 1306*a,* a circuit board 1308, first and second shielding plates 1310 and 1312, two elastic conductors 1314 and 1316, and a film carrier tape 1318. In this example, the above-described display information processing circuit 1002 (see FIG. 10) may be mounted on the circuit board 1308 or may be mounted on the MIM array substrate of the liquid crystal display panel 10. Further, the above-described drive circuit 1004 can also be mounted on the circuit board 1308.

Since the example shown in FIG. 13 is a pager, the circuit board 1308 or the like is provided. In contrast, if a liquid crystal display panel 10 which has drive circuit 1004 and display information processing circuit 1002 mounted thereon and which forms a liquid crystal display module is provided, a unit formed by fixing the liquid crystal display panel in a metallic frame 1302 may be produced, sold and used as a liquid crystal display apparatus or a unit in which these components and a light guide 1306 are incorporated may be produced, sold and used as a backlighted liquid crystal display apparatus.

Figure 14:
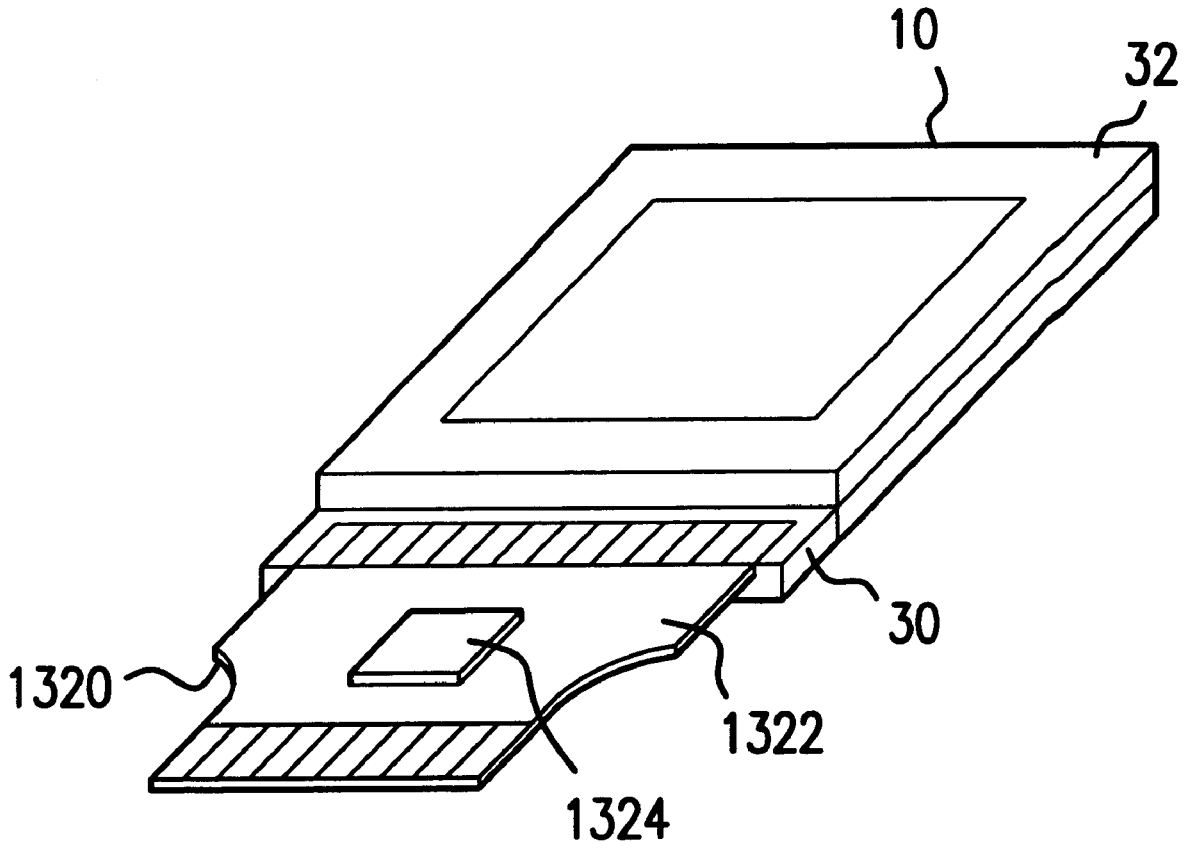
FIG. 14 is a cross-sectional view of a liquid crystal display apparatus using a TCP, which is an example of the electronic apparatus.
Figure 15:
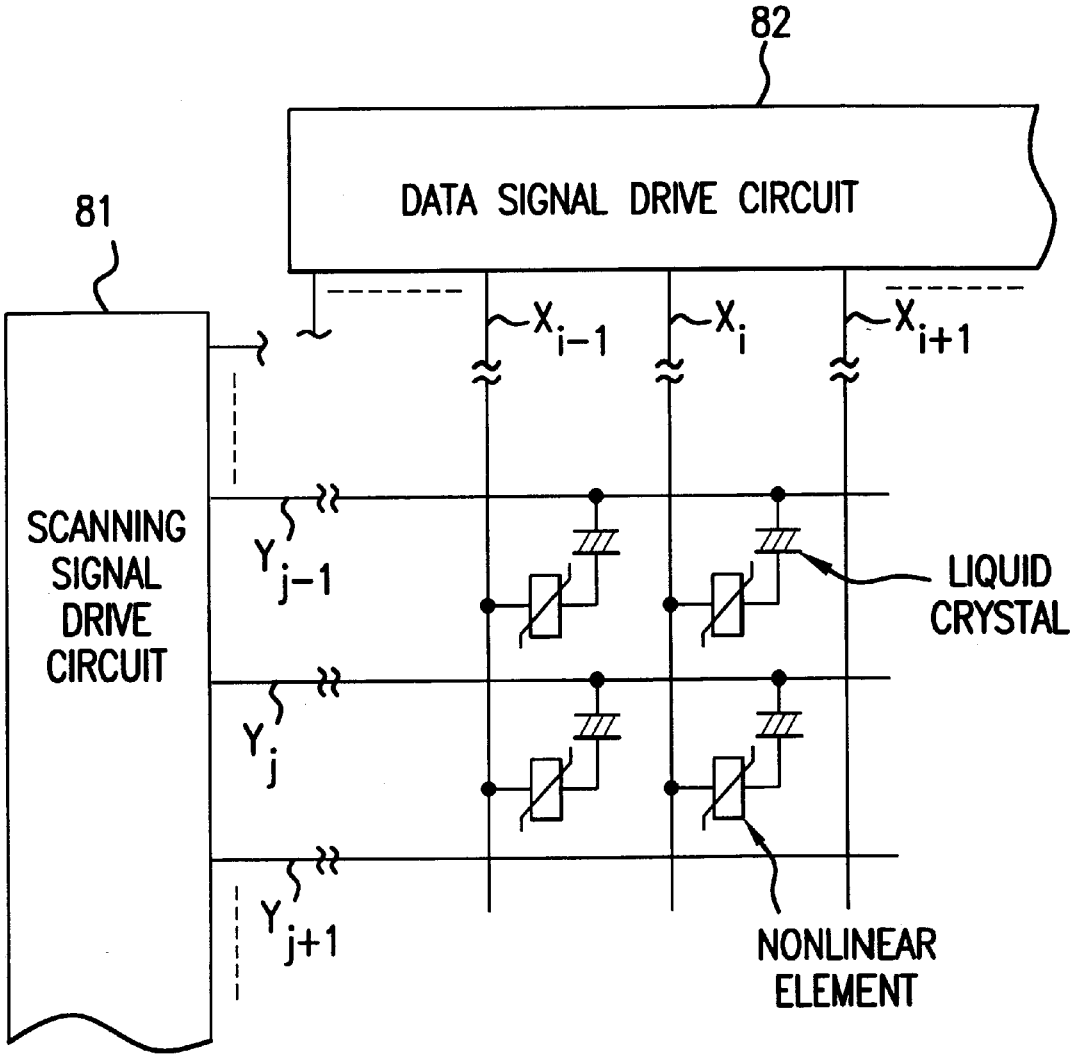
FIG.15 PRIOR ART
FIG. 15 is a diagram showing the basic construction of a conventional liquid crystal display panel using a MIM element and other components.
Figure 16A:
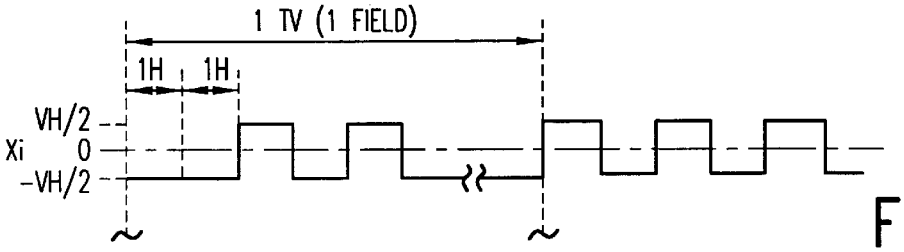
FIG.16A PRIOR ART
FIGS. 16(A)–16(C) are timing charts according to a conventional charge and discharge drive method.
Figure 16B:
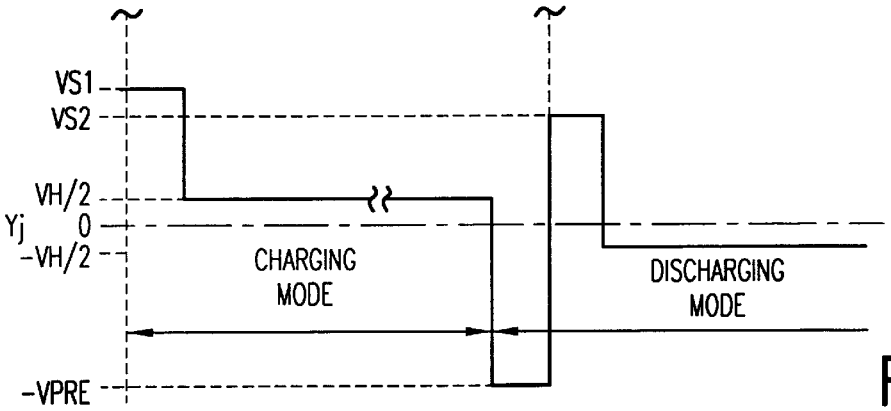
FIG.16B PRIOR ART
Figure 16C:
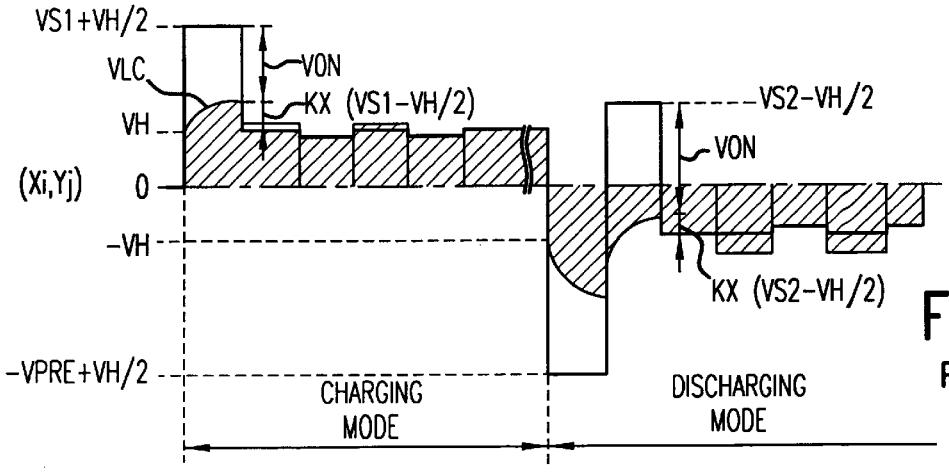
FIG.16C PRIOR ART
Figure 17A:
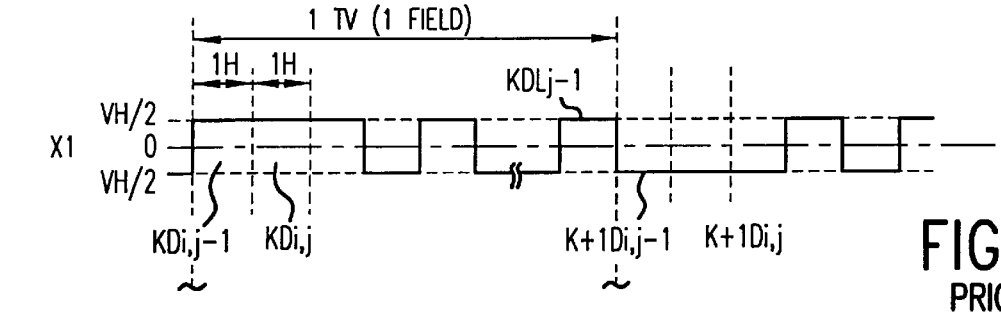
FIG.17A PRIOR ART
FIGS. 17(A)–17(D) are timing charts according to another conventional charge and discharge drive method.
Figure 17B:
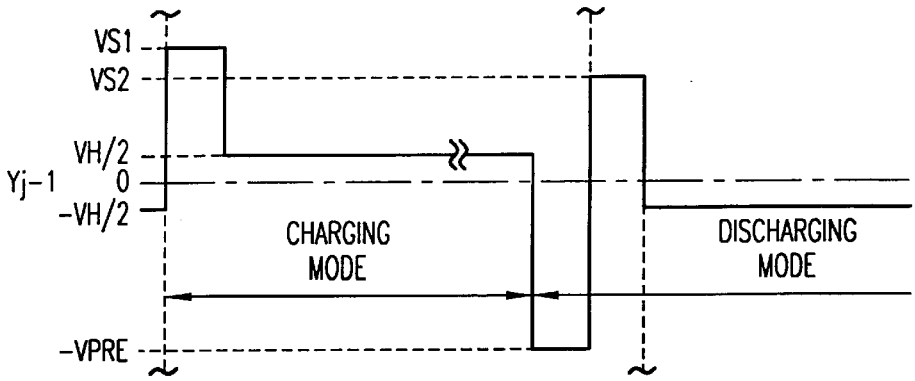
FIG.17B PRIOR ART
Figure 17C:
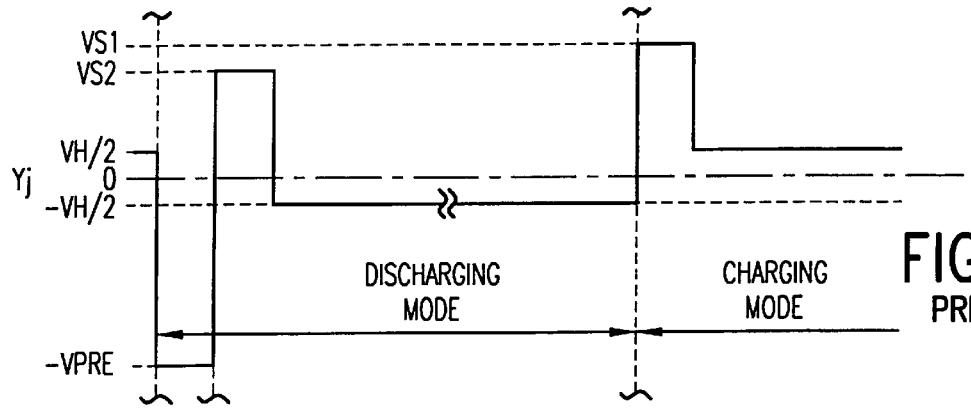
FIG.17C PRIOR ART
Figure 17D:
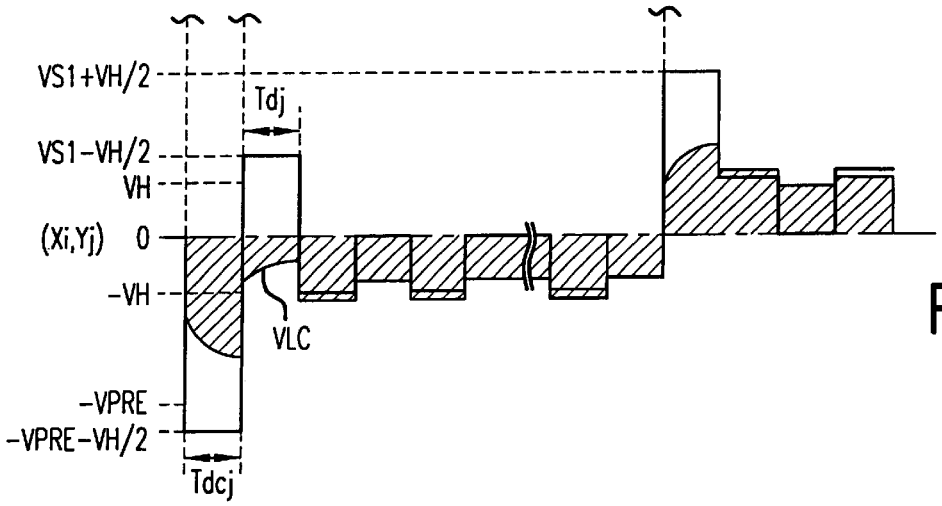
FIG.17D PRIOR ART

Referring to FIG. 14, a liquid crystal display panel on which drive circuit 1004 and display information processing circuit 1002 are not mounted may be connected, through an anisotropic conductive film provided on a peripheral portion of MIM array substrate 30, to a TCP (tape carrier package) 1320, in which an IC 1324 including drive circuit 1004 and display information processing circuit 1002 is mounted on a polyimide tape 1322, to be produced, sold and used as a liquid crystal display apparatus.

Examples of an electronic apparatus (shown in FIG. 10) in which the invention may be used, other than the electronic apparatuses described above with reference to FIGS. 11 to 14, are a liquid crystal television set, a viewfinder type or monitor direct viewing type video tape recorder, a car navigation apparatus, an electronic notebook, an electronic calculator, a word-processor, a worksation, a portable telephone set, a videophone set, a POS terminal, and an apparatus having a touch panel.

According to this embodiment, as described above, various electronic apparatuses having a comparatively simple construction, capable of improved grayshade display and having high reliability in grayshade display can be realized.

[Advantages]

According to the apparatus for driving a liquid crystal display panel, in the case where a scanning signal having a charging mode and a discharging mode is supplied to scanning lines in every horizontal period, a charging period in which the scanning signal has a first selecting voltage in the charging mode is set in a first horizontal period, an overcharging period in which the scanning signal has a precharge voltage in the discharging mode is set as the first half of a second horizontal period one vertical period after the first horizontal period, and a discharging period in which the scanning signal has a second selecting voltage is set as the second half of the second horizontal period. Also, with respect to the case where a data signal for controlling a grayshade of one pixel is supplied to one data line by a timing based on a cycle of one horizontal period, the data signal is supplied in the first period through which first selecting voltage is supplied, and is supplied both in the first half and in the second half of the second horizontal period in which the precharge voltage and the second selecting voltage are supplied. A variation in current-voltage characteristics of non-linear elements such as MIM elements can be absorbed to obtain an improved display characteristic and to reliably eliminate crosstalk of data signals. Further, a reduction in contrast can be prevented by performing adequate overcharging.

According to the apparatus for driving a liquid crystal display panel, a MIM element having the advantage of being simple in structure and being easily manufactured is specially employed to realize a liquid crystal display panel driving apparatus free from the occurrence of crosstalk of data signals and a reduction in contrast, having good characteristics and obtained at a low cost.

According to the liquid crystal display apparatus, a liquid crystal display apparatus can be realized which has a comparatively simple construction, which is free from occurrence of crosstalk of data signals and a reduction in contrast, which has good characteristics, and which is obtained at a low cost.

According to the electronic apparatus, various electronic apparatuses, e.g., a liquid crystal projector, a personal computer and a pager can be realized which are improved in terms of economy, which are free from occurrence of crosstalk of data signals and a reduction in contrast, and which have good characteristics.

According to the method of driving a liquid crystal display panel, in the case where a scanning signal having a charging mode waveform and a discharging mode waveform is supplied to scanning lines in every horizontal period, a writing period for a first selecting voltage in the charging mode waveform is set in a first horizontal period, a writing period for a precharge voltage in the discharging mode waveform is set as the first half of a second horizontal period first vertical period after the one horizontal period, and a writing period for a second selecting voltage is set as the second half of the second horizontal period. Also, a data signal synchronized with the charging mode waveform is supplied in the writing period (charging period) for this waveform, and a data signal synchronized with the discharging mode waveform is supplied both in the first half (overcharging period) and in the second half (discharging period) of the second horizontal period. A variation in current-voltage characteristics of non-linear elements such as MIM elements can be absorbed to obtain an improved display characteristic and to reliably eliminate crosstalk of data signals. Further, a reduction in contrast can be prevented by performing adequate overcharging.

What is claimed is:

1. An apparatus for driving a liquid crystal display panel in a liquid crystal display apparatus in which a plurality of scanning lines to which a scanning signal is applied and a plurality of data lines to which a data signal is applied are arranged so as to form a matrix, said liquid crystal display apparatus having a plurality of pixels each formed of a liquid crystal and a two-terminal type non-linear element connected in series between the plurality of scanning lines and the plurality of data lines, said driving apparatus comprising:

a scanning signal drive circuit that forms a scanning signal having a charging mode and a discharging mode, said charging mode having a first selecting voltage which makes said two-terminal type non-linear element conductive, said discharging mode having a precharge voltage which makes said two-terminal type non-linear element conductive and which is opposite in polarity to said first selecting voltage about a middle value of the data signal, and a second selecting voltage which is output subsequently to the precharge voltage and which is opposite in polarity to the precharge voltage about the middle value of the data signal, said scanning signal drive circuit that supplies the first selecting voltage of said charging mode in a first horizontal period, supplying the precharge voltage of said discharging mode in a first half of a second horizontal period one vertical period after said first horizontal period, and supplies the second selecting voltage of said discharging mode in a second half of the second horizontal period; and a data signal drive circuit that supplies, by timing based on a cycle of one horizontal period, the data signal for controlling a grayshade of each of said pixels in the period through which said first selecting voltage is supplied in the charging mode, and also supplies, by timing based on a cycle of one horizontal period, the data signal both in the first half and in the second half of said second horizontal period in which said precharge voltage and said second selecting voltage are supplied in the discharging mode.

2. An apparatus for driving a liquid crystal display panel according to claim 1, said two-terminal type non-linear element comprising a metal insulator metal (MIM) element.

3. A liquid crystal display apparatus comprising an apparatus for driving a liquid crystal display panel according to claim 1, and said liquid crystal display panel.

4. A liquid crystal display apparatus comprising an apparatus for driving a liquid crystal display panel according to claim 2, and said liquid crystal display panel.

5. An electronic apparatus comprising an apparatus for driving a liquid crystal display panel according to claim 1, and said liquid crystal display panel.

6. An electronic apparatus comprising an apparatus for driving a liquid crystal display panel according to claim 2, and said liquid crystal display panel.

7. A method of driving a liquid crystal display panel in a liquid crystal display apparatus in which a plurality of scanning lines to which a scanning signal is applied and a plurality of data lines to which a data signal is applied are arranged so as to form a matrix, said liquid crystal display apparatus having a plurality of pixels each formed of a liquid crystal and a two-terminal type non-linear element connected in series between the plurality of scanning lines and the plurality of data lines, said method comprising:

forming a scanning signal having a charging mode and a discharging mode, said charging mode having a first selecting voltage which makes said two-terminal type non-linear element conductive, said discharging mode having a precharge voltage which makes said two-terminal type non-linear element conductive and which is opposite in polarity to said first selecting voltage about a middle value of the data signal, and a second selecting voltage which is output subsequently to the precharge voltage and which is opposite in polarity to the precharge voltage about the middle value of the data signal, supplying the first selecting voltage of said charging mode in a first horizontal period, supplying the precharge voltage of said discharging mode in a first half of a second horizontal period one vertical period after said first horizontal period, and supplying the second selecting voltage of said discharging mode in a second half of the second horizontal period; and supplying, by timing based on a cycle of one horizontal period, the data signal for controlling a grayshade of each of said pixels in the period through which said first selecting voltage is supplied in the charging mode, and also supplying, by timing based on a cycle of one horizontal period, the data signal both in the first half and in the second half of the second horizontal period in which said precharge voltage and said second selecting voltage are supplied in the discharging mode.

8. A method of driving a liquid crystal display panel of claim 7, said two-terminal type non-linear element comprising a metal insulator metal (MIM) element.

9. A method of driving an electronic apparatus comprising a liquid crystal display panel in a liquid crystal display apparatus in which a plurality of scanning lines to which a scanning signal is applied and a plurality of data lines to which a data signal is applied are arranged so as to form a matrix, said liquid crystal display apparatus having a plurality of pixels each formed of a liquid crystal and a two-terminal type non-linear element connected in series between the plurality of scanning lines and the plurality of data lines, said method comprising:

forming a scanning signal having a charging mode and a discharging mode, said charging mode having a first selecting voltage which makes said two-terminal type non-linear element conductive, said discharging mode having a precharge voltage which makes said two-terminal type non-linear element conductive and which is opposite in polarity to said first selecting voltage about a middle value of the data signal, and a second selecting voltage which is output subsequently to the precharge voltage and which is opposite in polarity to the precharge voltage about the middle value of the data signal, supplying the first selecting voltage of said charging mode in a first horizontal period, supplying the precharge voltage of said discharging mode in a first half of a second horizontal period one vertical period after said first horizontal period, and supplying the second selecting voltage of said discharging mode in a second half of the second horizontal period; and supplying, by timing based on a cycle of one horizontal period, the data signal for controlling a grayshade of each of said pixels in the period through which said first selecting voltage is supplied in the charging mode, and also supplying, by timing based on a cycle of one horizontal period, the data signal both in the first half and in the second half of the second horizontal period in which said precharge voltage and said second selecting voltage are supplied in the discharging mode.

10. A method of driving an electronic apparatus of claim 9, said two terminal type non-linear element comprising a metal insulator metal (MIM) element.

11. An apparatus for driving a liquid crystal display panel in a liquid crystal display apparatus in which a plurality of scanning lines to which a scanning signal is applied and a plurality of data lines to which a data signal is applied are arranged so as to form a matrix, said liquid crystal display apparatus having a plurality of pixels each formed of a liquid crystal and a two-terminal type non-linear element connected in series between the plurality of scanning lines and the plurality of data lines, said driving apparatus comprising:

a scanning signal drive circuit that forms a scanning signal having a charging mode and a discharging mode, said charging mode having a first selecting voltage which makes said two-terminal type non-linear element conductive, said discharging mode having a precharge voltage which makes said two-terminal type non-linear element conductive and which is opposite in polarity to said first selecting voltage about a middle value of the data signal, and a second selecting voltage which is output subsequently to the precharge voltage and which is opposite in polarity to the precharge voltage about the middle value of the data signal, said scanning signal drive circuit that supplies the first selecting voltage of said charging mode in a first horizontal period, supplies the precharge voltage of said discharging mode in a first period of a second horizontal period one vertical period after said first horizontal period, and supplies the second selecting voltage of said discharging mode in a second period of the second horizontal period; and a data signal drive circuit that supplies, by timing based on a cycle of one horizontal period, the data signal for controlling a grayshade of each of said pixels in the period through which said first selecting voltage is supplied in the charging mode, and also supplies, by timing based on a cycle of one horizontal period, the data signal in said first period in which said precharge voltage is supplied and said second period in which said second selecting voltage is supplied in the discharging mode.

12. An apparatus for driving a liquid crystal display panel according to claim 11, said two-terminal type non-linear element comprising a metal insulator metal (MIM) element.

13. A liquid crystal display apparatus comprising an apparatus for driving a liquid crystal display panel according to claim 11, and said liquid crystal display panel.

14. A liquid crystal display apparatus comprising an apparatus for driving a liquid crystal display panel according to claim 12, and said liquid crystal display panel.

15. An electronic apparatus comprising an apparatus for driving a liquid crystal display panel according to claim 11, and said liquid crystal display panel.

16. An electronic apparatus comprising an apparatus for driving a liquid crystal display panel according to claim 12, and said liquid crystal display panel.

17. A method of driving a liquid crystal display panel in a liquid crystal display apparatus in which a plurality of scanning lines to which a scanning signal is applied and a plurality of data lines to which a data signal is applied are arranged so as to form a matrix, said liquid crystal display apparatus having a plurality of pixels each formed of a liquid crystal and a two-terminal type non-linear element connected in series between the plurality of scanning lines and the plurality of data lines, said method comprising:

forming a scanning signal having a charging mode and a discharging mode, said charging mode having a first selecting voltage which makes said two-terminal type non-linear element conductive, said discharging mode having a precharge voltage which makes said two-terminal type non-linear element conductive and which is opposite in polarity to said first selecting voltage about a middle value of the data signal, and a second selecting voltage which is output subsequently to the precharge voltage and which is opposite in polarity to the precharge voltage about the middle value of the data signal, supplying the first selecting voltage of said charging mode in a first horizontal period, supplying the precharge voltage of said discharging mode in a first period of a second horizontal period one vertical period after said first horizontal period, and supplying the second selecting voltage of said discharging mode in a second period of the second horizontal period; and supplying, by timing based on a cycle of one horizontal period, the data signal for controlling a grayshade of each of said pixels in the period through which said first selecting voltage is supplied in the charging mode, and also supplying, by timing based on a cycle of one horizontal period, the data signal both in the first period in which said precharge voltage is supplied and the second period in which said second selecting voltage is supplied in the discharging mode.

18. A method of driving a liquid crystal display panel of claim 17, said two-terminal type non-linear element comprising a metal insulator metal (MIM) element.

19. A method of driving an electronic apparatus comprising a liquid crystal display panel in a liquid crystal display apparatus in which a plurality of scanning lines to which a scanning signal is applied and a plurality of data lines to which a data signal is applied are arranged so as to form a matrix, said liquid crystal display apparatus having a plurality of pixels each formed of a liquid crystal and a two-terminal type non-linear element connected in series between the plurality of scanning lines and the plurality of data lines, said method comprising:

forming a scanning signal having a charging mode and a discharging mode, said charging mode having a first selecting voltage which makes said two-terminal type non-linear element conductive, said discharging mode having a precharge voltage which makes said two-terminal type non-linear element conductive and which is opposite in polarity to said first selecting voltage about a middle value of the data signal, and a second selecting voltage which is output subsequently to the precharge voltage and which is opposite in polarity to the precharge voltage about the middle value of the data signal, supplying the first selecting voltage of said charging mode in a first horizontal period, supplying the precharge voltage of said discharging mode in a first period of a second horizontal period one vertical period after said first horizontal period, and supplying the second selecting voltage of said discharging mode in a second period of the second horizontal period; and supplying, by timing based on a cycle of one horizontal period, the data signal for controlling a grayshade of each of said pixels in the period through which said first selecting voltage is supplied in the charging mode, and also supplying, by timing based on a cycle of one horizontal period, the data signal both in the first period in which said precharge voltage is supplied and the second period in which said second selecting voltage is supplied in the discharging mode.

20. A method of driving an electronic apparatus of claim 19, said two terminal type non-linear element comprising a metal insulator metal (MIM) element.

21. An apparatus for driving a liquid crystal display panel according to claim 1, in both of the first half and the second half of the second horizontal period, the data signal is supplied with a constant polarity.

22. A method of driving a liquid crystal display panel of claim 7, in both of the first half and the second half of the second horizontal period, the data signal is supplied with a constant polarity.

23. A method of driving an electronic apparatus of claim 9, in both of the first half and the second half of the second horizontal period, the data signal is supplied with a constant polarity.

24. An apparatus for driving a liquid crystal display panel according to claim 11, in both of the first period and the second period of the second horizontal period, the data signal is supplied with a constant polarity.

25. A method of driving a liquid crystal display panel according to claim 17, in both of the first period and the second period of the second horizontal period, the data signal is supplied with a constant polarity.

26. A method of driving an electronic apparatus of claim 19, in both of the first period and the second period of the second horizontal period, the data signal is supplied with a constant polarity.

* * * * *